US011285598B2

(12) United States Patent
Aoyama et al.

(10) Patent No.: US 11,285,598 B2
(45) Date of Patent: Mar. 29, 2022

(54) WORK STAND FOR POWER TOOL AND BRACKET THEREFOR

(71) Applicant: MAKITA CORPORATION, Anjo (JP)

(72) Inventors: Syuji Aoyama, Anjo (JP); Toshiyuki Kani, Anjo (JP); Shoichi Ishikawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 102 days.

(21) Appl. No.: 16/854,374

(22) Filed: Apr. 21, 2020

(65) Prior Publication Data

US 2020/0338716 A1 Oct. 29, 2020

(30) Foreign Application Priority Data

Apr. 24, 2019 (JP) ..... JP2019-083204
Jan. 27, 2020 (JP) ..... JP2020-011081

(51) Int. Cl.
*B25H 1/04* (2006.01)

(52) U.S. Cl.
CPC ..... *B25H 1/04* (2013.01)

(58) Field of Classification Search
CPC ..... B25H 1/04; B25H 1/0021; B25H 1/005; B25H 3/18; B23Q 3/02; B23Q 3/186;
(Continued)

(56) References Cited

U.S. PATENT DOCUMENTS 2,958,873 A 11/1960 Ferneau
6,745,804 B2 * 6/2004 Welsh ..... B25H 1/04 144/287
(Continued)

FOREIGN PATENT DOCUMENTS

JP 2016064493 A 4/2016

OTHER PUBLICATIONS

Instruction Manual for Makita's Miter Saw Stand Model No. WST06, available to the public at least as early as Feb. 2018.
(Continued)

*Primary Examiner* — Orlando E Aviles
*Assistant Examiner* — Robert F Neibaur
(74) *Attorney, Agent, or Firm* — J-Tek Law PLLC; Jeffrey D. Tekanic; Scott T. Wakeman

(57) ABSTRACT

A bracket (20) includes: a pedestal (21, 22) that is mountable on a support frame (2) of a work stand (1) for supporting a saw (60); and first and second engaging parts (38A, 38B) arranged on the pedestal to sandwich the support frame in a horizontal direction and engage with first and second engagement parts (8A, 8B) on opposite sides of the support frame. The second engaging part includes first and second levers (41, 42). The pedestal is movable along the longitudinal direction of the support frame by manipulating only the first lever to disengage it from the second engagement part (8B) and is removable from the support frame by simultaneously manipulating both the first and second levers in the same direction to disengage them from the second engagement part. The first and second levers both move in the same opposite direction to engage the second engagement part.

20 Claims, 13 Drawing Sheets

(58) Field of Classification Search
CPC ..... B25B 5/006; B25B 5/02; B25B 5/068; B25B 5/16; B25B 5/163; B25B 5/166
USPC ..... 269/309, 290, 296, 294, 295, 136–138, 269/16, 291
See application file for complete search history.

(56) References Cited

U.S. PATENT DOCUMENTS

| | | | | |
|---|---|---|---|---|
| 7,055,847 | B2 * | 6/2006 | Miller | B62B 3/022 248/161 |
| 7,213,829 | B2 | 5/2007 | Wu | |
| 7,222,648 | B2 * | 5/2007 | Liu | B23D 47/02 144/286.5 |
| 7,631,847 | B2 * | 12/2009 | Harrison | B25H 1/04 248/229.1 |
| 7,690,408 | B2 | 4/2010 | Sugiura | |
| 8,684,052 | B2 * | 4/2014 | Breitenbach | B25H 1/06 144/286.1 |
| 9,186,810 | B1 * | 11/2015 | Chang | B27B 27/08 |
| 2007/0240937 | A1 * | 10/2007 | Borgstede | B23D 47/02 182/129 |
| 2008/0115701 | A1 | 5/2008 | Sugiura | |
| 2009/0007987 | A1 * | 1/2009 | Thomas | B23D 47/025 144/286.1 |
| 2019/0351532 | A1 * | 11/2019 | Lai | B25B 5/02 |

OTHER PUBLICATIONS

Parts Breakdown for Makita's Miter Saw Stand Model No. WST06, available to the public at least as early as Feb. 2018.

* cited by examiner

WORK STAND FOR POWER TOOL AND BRACKET THEREFOR

CROSS-REFERENCE

The present application claims priority to Japanese patent application serial number 2019-083204 filed on Apr. 24, 2019 and to Japanese patent application serial number 2020-011081 filed on Jan. 27, 2020, the contents of both of which are incorporated fully herein by reference.

TECHNICAL FIELD

The present invention generally relates to a work stand bracket, which is used to fix a power tool, such as a miter saw or a compound slide miter saw, on a work stand, and to a work stand that uses such a work stand bracket.

BACKGROUND ART

In the field of power tools, a work stand may be used to improve work efficiency when operating a benchtop (tabletop) tool, such as a miter saw or a compound slide miter saw, etc. Japanese Patent Application Publication No. 2016-64493 discloses such a work stand that comprises a support frame (main frame), which has an elongated-plank shape, and legs, which support the support frame. The compound slide miter saw is detachably fixed to the support frame via movable racks (work stand brackets), which are slidable on the upper surface of the support frame in a longitudinal direction and are fixable at any arbitrary longitudinal position. Each of the work stand brackets comprises a slide base, which is slidable on the upper surface of the support frame, and a frame (rail), which is connected to the slide base orthogonally to the support frame and to which the compound slide miter saw is fixed by a bolt. Therefore, by pivotally moving a lever part of a lock lever provided on the upper surface of the slide base (lock bracket), a lock block, which is provided on a lower surface, is caused to engage a lock groove, which is formed on the upper surface of the support frame. Consequently, according to this design, the slide bases are lockable at any arbitrary slide (longitudinal) position, thereby enabling a wide range of different power tools having bases of different widths to be securely mounted on the work stand.

SUMMARY OF THE INVENTION

However, when the above-described known work stand brackets are in the locked state, but the users wishes to slide them longitudinally on the support frame or mount them on or demount (remove) them from the support frame, it is necessary to first pivot both the lever parts in opposite directions, and then slide or lift up the slide bases (when mounting, the slide bases are placed on the support frame). Therefore, the positional adjustment of the brackets, the work for the mounting of the brackets on and demounting of the brackets from the support frame, etc. cannot be performed smoothly. In addition, because the lever parts protrude upwardly from the upper surface of the brackets (slide bases), there is also a risk that the lever parts will interfere with the work that is being performed by the power tool mounted on the work stand.

Accordingly, it is one, non-limiting object of the present teachings to provide an improved work stand and an improved bracket therefor, which enable the work of mounting the bracket on and demounting (removing) the bracket from a support frame to be more performed smoothly (easily), and in which the work stand bracket is also lockable (clampable on the support frame) in a reliable manner.

In addition or in the alternative, another non-limiting object of the present teachings is to provide an improved work stand and bracket therefor, which enable positional adjustments of the bracket(s) on the support frame and demounting to be performed more smoothly (easily).

In one aspect of the present teachings, a work stand bracket for fixing a power tool, which is provided on a support frame of a work stand having legs that support the support frame, comprises: a pedestal, which is mounted on the support frame and to which the power tool is fixable; and two engaging parts, which are provided on the pedestal at locations at which they sandwich the support frame from both sides in a horizontal direction orthogonal to the support frame and which are capable of engaging with engagement parts provided on both sides of the support frame. At least one of the two engaging parts comprises a first manipulation part and a second manipulation part, which can be manipulated to engage with and disengage from one of the engagement parts. The pedestal is removable from the support frame by performing an unlocking (release) manipulation on both the first manipulation part and the second manipulation part to disengage them from the one engagement part. Locking/unlocking-manipulation directions of the first manipulation part and the second manipulation part are the same. If the first manipulation part alone undergoes the unlocking (release) manipulation, then it becomes impossible for the second manipulation part to undergo the unlocking manipulation.

In one embodiment of the first aspect, the first manipulation part and the second manipulation part are a first lever and a second lever, respectively, whose end portions are pivotably coupled to the pedestal, and their pivoting-manipulation directions, i.e. the locking/unlocking-manipulation directions thereof, are the same.

In another embodiment of the first aspect, the pivot centers of the first lever and the second lever are disposed such that they are offset from one another in the horizontal direction. In addition, a contact portion, which makes contact with the second lever when the first lever alone undergoes the unlocking (release) manipulation, is provided on the first lever. When the second lever makes contact with the contact portion on the first lever, it becomes impossible for the second lever to undergo the unlocking (release) manipulation.

In another embodiment of the first aspect, as the first lever pivots, the contact portion pivotably biases the second lever in the locking (engagement, clamping) direction toward the one engagement part.

In another embodiment of the first aspect, the contact portion is a flat part that, as the first lever pivots, assumes a tilted attitude and pivotably biases the second lever in the locking (engagement, clamping) direction.

In a second aspect of the present teachings, a work stand bracket for fixing a power tool, which is provided on a support frame of a work stand having legs that support the support frame, comprises: a pedestal, which is mounted on the support frame and to which the power tool is fixable; and two engaging parts, which are provided on the pedestal at locations at which they sandwich the support frame from both sides in a horizontal direction orthogonal to the support frame and which are capable of engaging with engagement parts provided on both sides of the support frame. At least one of the two engaging parts comprises a first manipulation part and a second manipulation part, which can be manipulated to engage with and disengage from one of the engagement parts. The pedestal is movable (longitudinally) along the support frame by performing an unlocking (release) manipulation on the first manipulation part to disengage it from the one engagement part. The pedestal is removeable from the support frame by performing an unlocking (release) manipulation on both the first manipulation part and the second manipulation part (at the same time) to disengage them from the one engagement part. Locking/unlocking-manipulation directions of the first manipulation part and the second manipulation part are the same.

In one embodiment of the second aspect, the first manipulation part and the second manipulation part are a first lever and a second lever, respectively, whose end portions are pivotably coupled to the pedestal, and their pivoting-manipulation directions, i.e. the locking/unlocking-manipulation directions thereof, are the same.

In another embodiment of the second aspect, the pivot centers of the first lever and the second lever are disposed such that they are offset from one another in the horizontal direction. In addition, stoppers, which make contact with one another and restrict (block) pivoting of both levers when the unlocking (release) manipulation is performed on only one of the first lever and the second lever, are provided on the first lever and the second lever.

In another embodiment of the second aspect, the second lever is housed inside a slit, which is provided in the first lever and is oriented in the horizontal direction.

In a third aspect of the present teachings, a work stand bracket for fixing a power tool, which is provided on a support frame of a work stand having legs that support the support frame, comprises: a pedestal, which is mounted on the support frame and to which the power tool is fixable; and two engaging parts, which are provided on the pedestal at locations at which they sandwich the support frame from both sides in a horizontal direction orthogonal to the support frame and which are capable of engaging with engagement parts provided on both sides of the support frame. At least one of the two engaging parts comprises a manipulation part, which can be manipulated to engage with and disengage from one of the engagement parts, and a restricting part, which restricts the range of movement of the manipulation part. The pedestal is removable from the support frame by moving the manipulation part and the restricting part in the same direction (at the same time).

In one embodiment of the third aspect, if the manipulation part alone (only) is manipulated in the unlocking (release) direction away from the one engagement part, then the manipulation part makes contact with the restricting part, which restricts further movement of the manipulation part in the unlocking (release) direction.

In another embodiment of the third aspect, the manipulation part is a first lever, whose end portion is pivotably coupled to the pedestal; and the restricting part is a second lever, whose end portion is pivotably coupled to the pedestal.

In another embodiment of the third aspect, the pivot centers of the first lever and the second lever are disposed such that they are offset from one another in the horizontal direction.

In a fourth aspect of the present teachings, a work stand comprises: a support frame, to which a power tool is fixable (via a work stand bracket); and legs, which support the support frame. The work stand bracket according to any one of the above-described aspects or embodiments thereof is provided on the support frame such that it is mountable on and demountable from the support frame. The power tool is fixable to the work stand bracket.

In one or more aspects or embodiments of the present teachings, the work of mounting the work stand bracket on and demounting (removing) the work stand bracket from a support frame can be performed more smoothly (easily), thereby improving work efficiency while still providing reliable locking (engagement, clamping) of the work stand bracket on the support frame.

In addition, in one or more aspects or embodiments of the present teachings, the work of positionally adjusting, mounting, or demounting the work stand bracket on the support frame can be more performed smoothly (easily), thereby improving work efficiency.

Further objects, aspects, embodiments and advantages of the present teachings will become apparent upon reading the following detailed description in view of the appended drawings and claims.

BRIEF DESCRIPTION OF THE DRAWINGS

FIGS. 9A-9C are explanatory diagrams that show the manipulation (movement) of first and second levers according to the first embodiment, wherein FIG. 9A shows the state in which the first lever alone (only) has been pivoted, FIG. 9B shows an initial state of pivoting both of the first and second levers at the same time, and FIG. 9C shows the state in which both of the first and second levers have been squeezed such that their end (terminal) portions have been moved to their uppermost position.

FIGS. 10A-10D are explanatory diagrams of the first lever according to a second embodiment, wherein FIG. 10A is an oblique view from the front, FIG. 10B is a left view, FIG. 10C is a front view, and FIG. 10D is a cross-sectional view taken along line E-E in FIG. 10C.

FIGS. 11A-C are explanatory diagrams of the second lever according to the second embodiment, wherein FIG. 11A is an oblique view from the rear, FIG. 11B is a left view, and FIG. 11C is a front view.

DETAILED DESCRIPTION OF THE INVENTION

Embodiments of the present invention are explained below, with reference to the drawings.

First Embodiment

Figure 1:
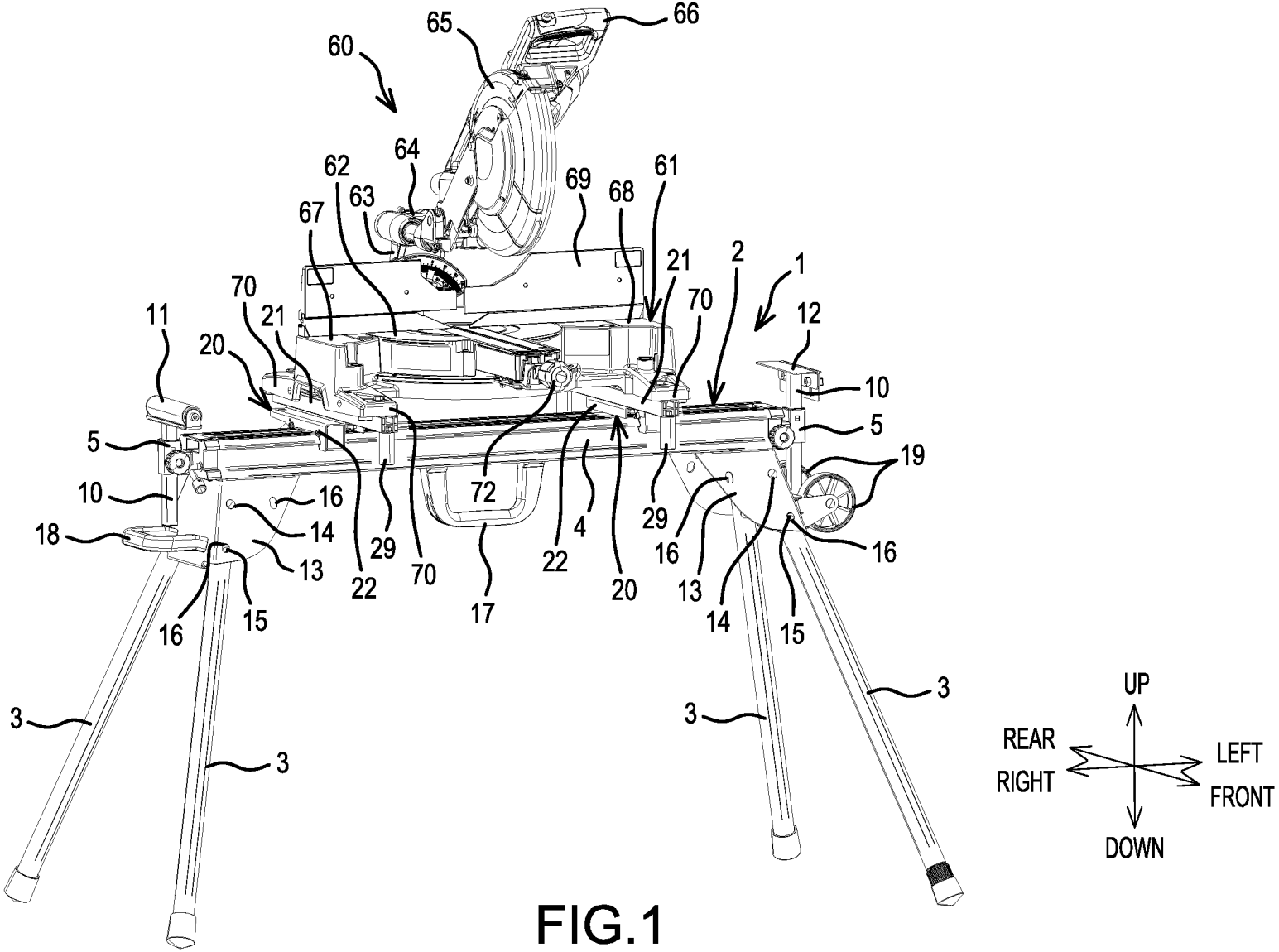
FIG. 1 is an oblique view of a work stand according to a first embodiment of the present teachings.
Figure 2:
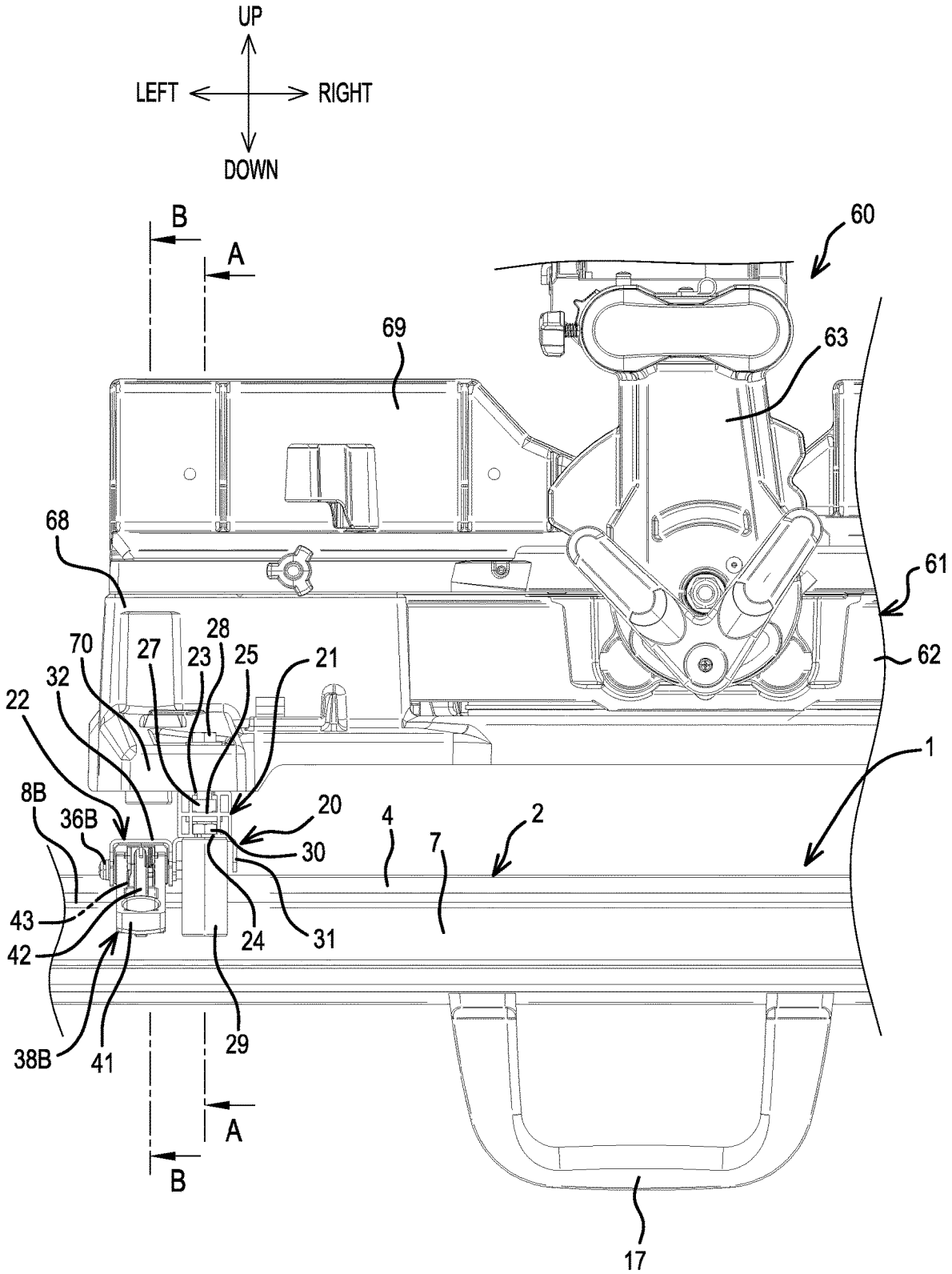
FIG. 2 is an enlarged rear view of a left-side portion of a compound slide miter saw mounted on the work stand according to the first embodiment.

FIG. 1 is an oblique view that shows one exemplary example of a work stand 1, on which a compound slide miter saw 60 is mountable and fixable (securable), and FIG. 2 is an enlarged rear view of a left-side portion of the compound slide miter saw 60 and the work stand 1.

The work stand 1 comprises a support frame 2 and four legs 3, which horizontally support the support frame 2 at a prescribed height in the vertical direction. The compound slide miter saw 60 is fixable to the support frame 2 via two work stand brackets 20, which are provided on the support frame 2.

Figure 3:
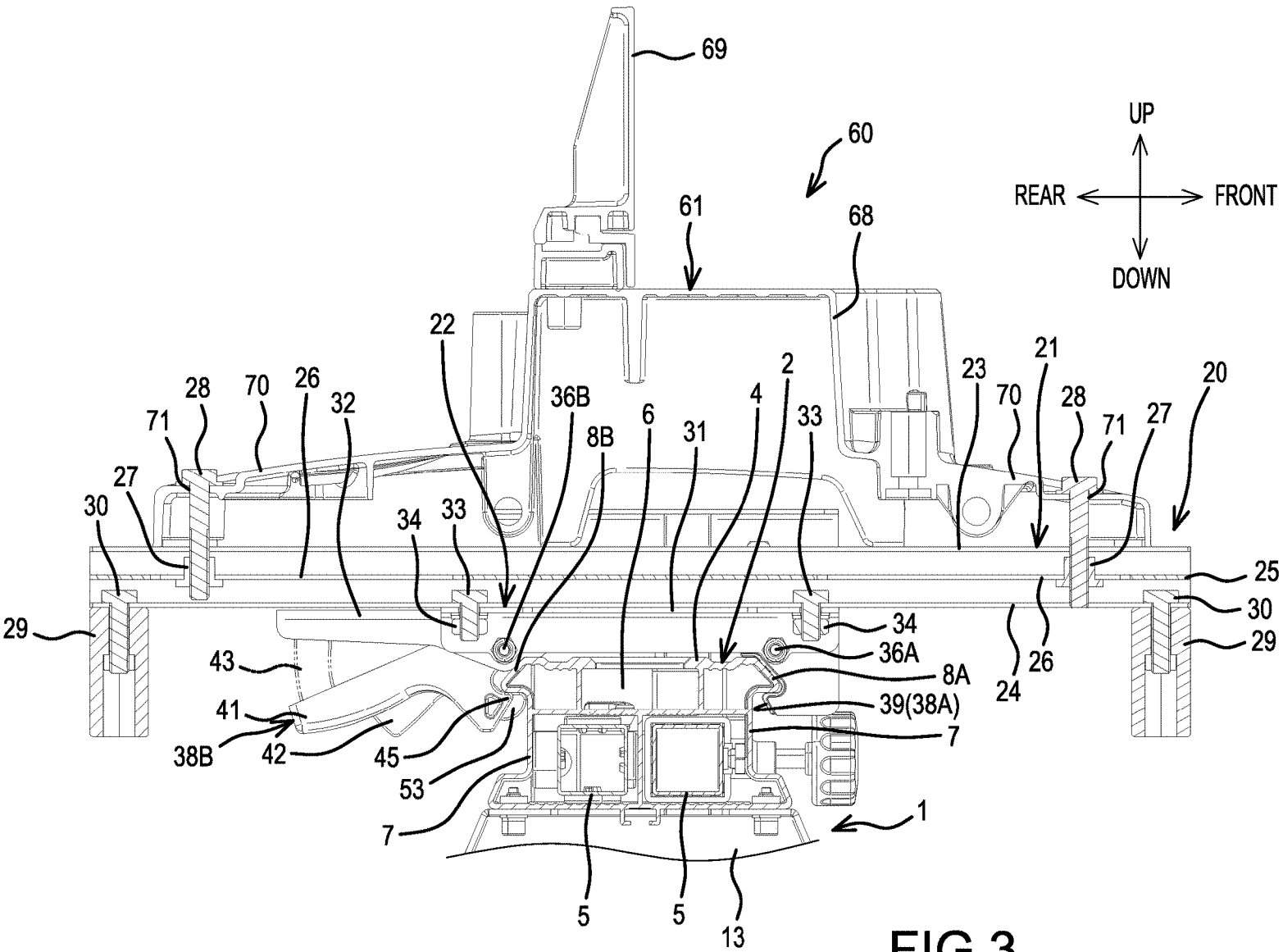
FIG. 3 is primarily a cross-sectional view taken along line A-A in FIG. 2, but also includes structures concerning a lower-side pedestal in the cross-sectional view taken along line B-B in FIG. 2.

The support frame 2 comprises a stand main body (main frame) 4, which has an elongated-plank (rail) shape. First and second auxiliary bars (extendable wings) 5 are respectively coupled to the stand main body 4 at the two ends thereof in the longitudinal direction such that the first and second auxiliary bars 5 can be independently slidably inserted into and withdrawn from the stand main body 4 in the longitudinal direction. As will be further discussed below, a hollow polygonal (e.g., square or rectangular) sleeve (not separately numbered) is formed (located) at a terminal end of each of the first and second auxiliary bars 5 such that the hollow interior of each of the sleeves extends in the vertical direction. As shown in FIG. 3, the outer periphery of the transverse cross section of the stand main body 4 is substantially a rectangular shape, a lock groove 6 is formed in the center of an upper surface of the stand main body 4 in the width direction and along the entire length thereof, and two side grooves 7 are respectively formed on front- and rear-side surfaces of the stand main body 4 and along the entire length thereof. Owing to the formation of the two side grooves 7, two (first and second) engagement parts (longitudinally-extending flanges or cantilevers) 8A, 8B are respectively formed on front and rear edge upper parts of the stand main body 4 on the two sides thereof and extend along the entire (longitudinal) length of the stand main body 4. The first and second engagement parts (flanges or cantilevers) 8A, 8B are each formed as a tilted (inclined) surface such that the (inclined) upper surface of the first engagement part 8A descends at an angle in the downward direction in the forward direction and the (inclined) upper surface of the second engagement part 8B descends at an angle in the downward direction in the rearward direction. A bottom surface of each of the first and second engagement parts 8A, 8B is flat, i.e. extends in a horizontal plane perpendicular to the vertical direction.

Each of the first and second auxiliary bars 5 has a polygonal cross-sectional (e.g. hollow square) shape and is slidably inserted, with clearance, into and out of the stand main body 4 so as to be fixable at any arbitrary longitudinal position relative to the stand main body 4 by rotatably tightening a corresponding first lock knob (shown but not numbered). First and second support rods (support brackets) 10 are respectively inserted through the above-described sleeves at the terminal ends of the first and second auxiliary bars 5 such that the support rods 10 are each capable of independently moving (sliding) in the vertical (up-down) direction, and are fixable at any arbitrary vertical position relative to the auxiliary bars 5 by rotatably tightening a corresponding second lock knob (shown but not numbered). A support roller 11 is provided on an upper end of the first (right-side) support rod 10 and the shaft of the roller 11 is oriented in the front-rear direction. In addition, a support plate 12 is provided on an upper end of the second (left-side) support rod 10 and has the shape of an L turned on its side in the front-rear direction. The height of the support roller 11 and the height of the support plate 12 can each be independently fixed such that they are, e.g., aligned (flush) with an upper surface (workpiece support surface and/or turntable) of a base 61 of the compound slide miter saw 60.

Two pairs of the legs 3 are respectively coupled to two main support brackets (coupling plates) 13, which are fixed to a lower surface of the stand main body 4 on both ends thereof in the longitudinal direction. Each of the main support brackets 13 has a substantially U shape in plan view. As can be seen in FIG. 1, the upper ends of the legs 3 are rotatably (pivotably) coupled via shafts (bolts) 14 to the front and rear upper ends of the main support brackets 13. In addition, depressible (spring loaded) buttons (pins) 15 protrude from the legs 3 downward of the shafts 14. When the legs 3 are pivoted about the shafts 14 to the pulled-out (standing) position, the buttons 15 are biased to respectively protrude through the lower stopper holes 16 in the main support brackets 13, thereby locking the legs 3 in the pulled-out (standing) position. On the other hand, when the legs 3 are pivoted about the shafts 14 and thereby folded toward the interior for compactly transporting the work stand 1, the buttons 15 are biased to respectively protrude through the inward stopper holes 16 in the main support brackets 13, thereby locking the legs 3 in the folded position. At the center of the lower surface of the stand main body 4, a carry handle 17 is provided for turning over and transporting (e.g., carrying) the work stand 1 in the state in which all the legs 3 have been folded inward.

Furthermore, a pull handle 18 is provided on an outer surface of the right-side main support bracket 13, and a pair of wheels 19 is provided on an outer surface of the left-side main support bracket 13. Therefore, by grasping the pull handle 18 and setting the wheels 19 on the ground in the state in which at least the legs 3 attached to the left-side main support bracket 13 have been folded, the work stand 1 can be easily transported (rolled) without having to lift it up entirely.

Figure 4:
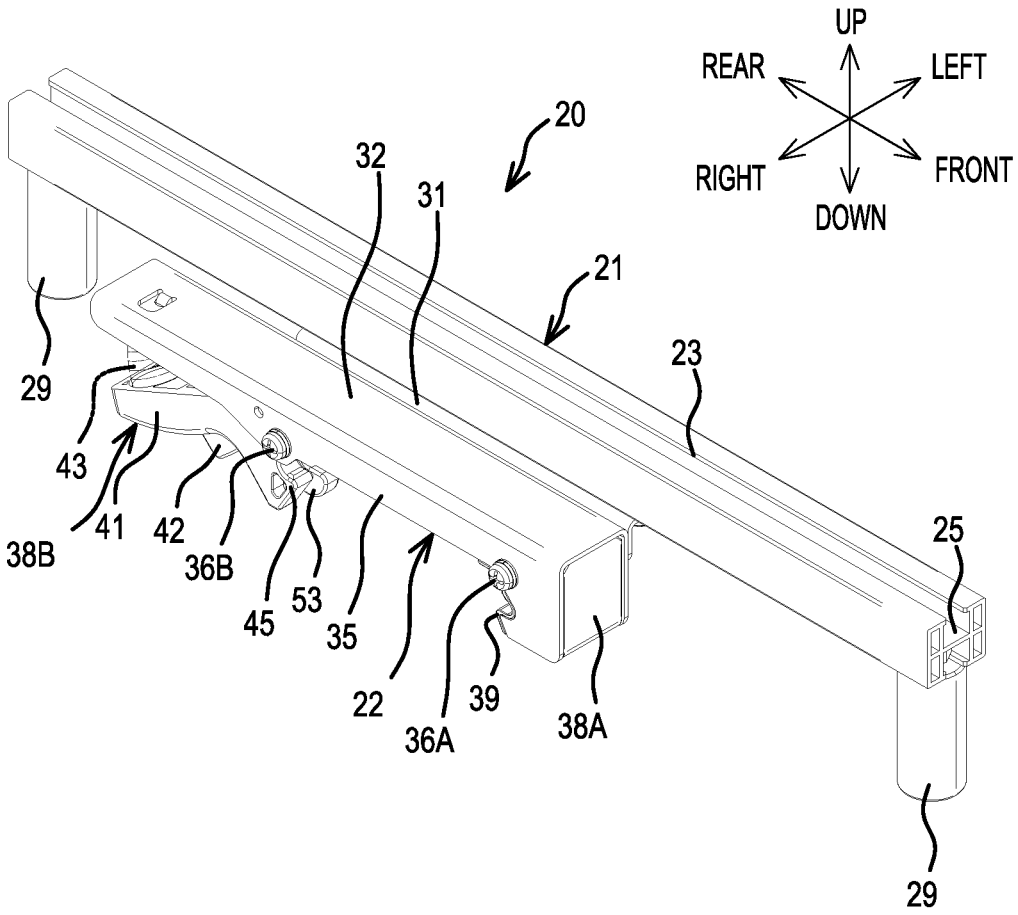
FIG. 4 is an oblique view, viewed from above, of a work stand bracket according to the first embodiment.
Figure 5:
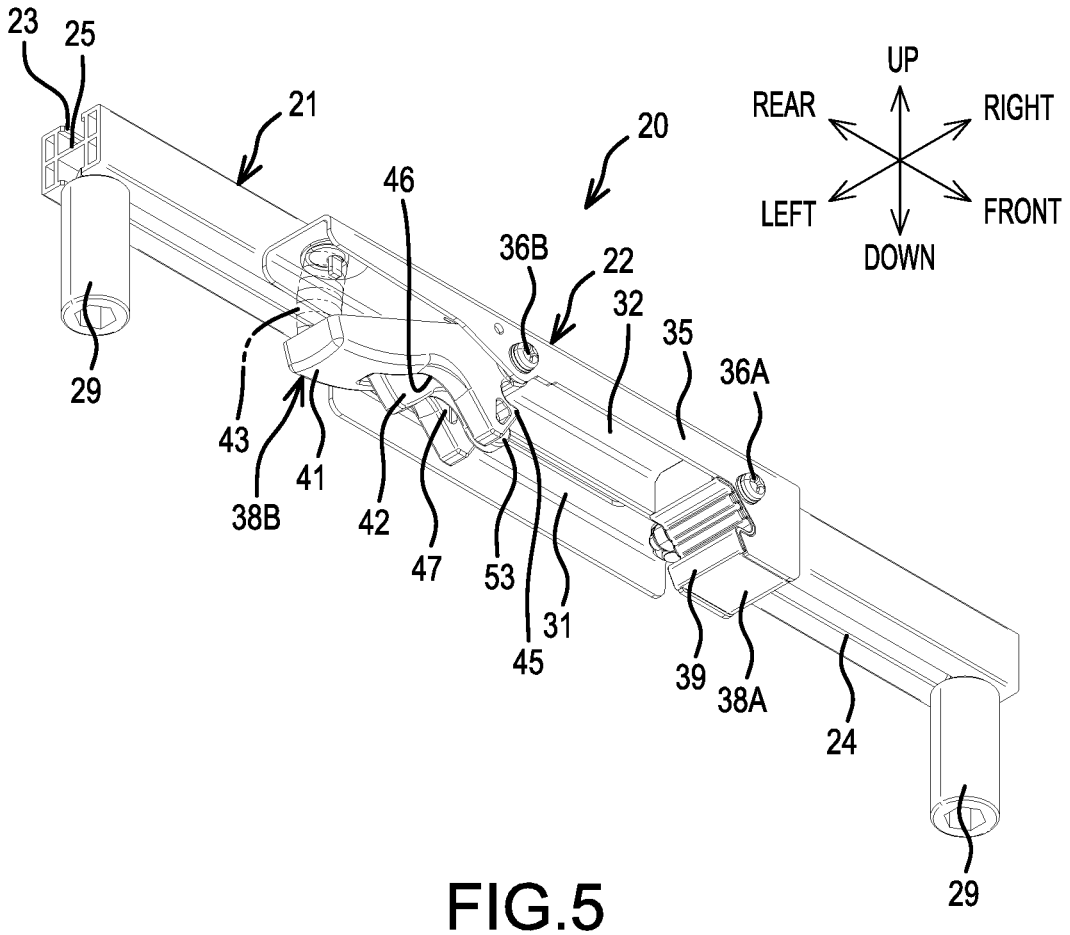
FIG. 5 is an oblique view, viewed from below, of the work stand bracket according to the first embodiment.
Figure 6:
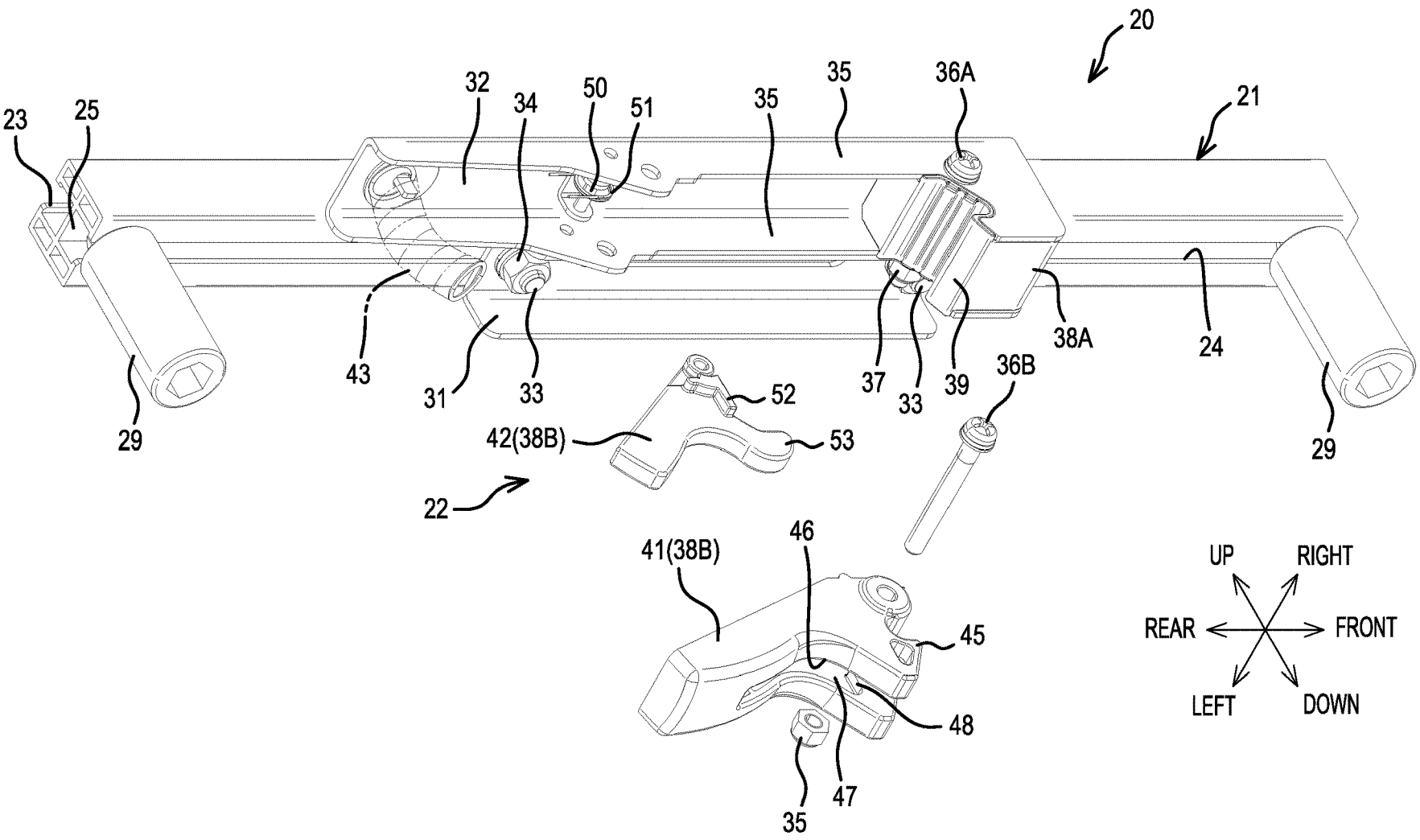
FIG. 6 is an exploded oblique view of the work stand bracket according to the first embodiment.

Furthermore, as shown also in FIGS. 4-6, the work stand bracket 20 (hereinbelow, referred to simply as "bracket") comprises an upper-side pedestal (sliding rail) 21, on which the compound slide miter saw 60 is fixed, and a lower-side pedestal (sliding rail) 22, which is fixed to the lower surface of the upper-side pedestal 21 and is adapted/configured to be mounted on and demounted (removed) from the stand main body 4, as will be further explained below. The lower-side pedestals 22 of the left and right brackets 20 each have left-right symmetry only and have the same structure overall. FIGS. 4-6 show the right-side bracket 20 for illustration and explanation purposes, because the left-side bracket 20 may be substantial identical thereto, except for the fact that the lower-side pedestals 22 are connected to the upper-side pedestals 21 in a mirror image to each other (i.e. the upper-side pedestals 21 are disposed longitudinally inward and the lower-side pedestals 22 are disposed longitudinally outward).

The upper-side pedestal 21 has a tubular (hollow polygonal) shape, which is preferably square-shaped in transverse cross section. An upper slit 23 and a lower slit 24 are formed in an upper surface and a lower surface, respectively, along the entire (longitudinal) length of the upper-side pedestal 21. A center plate 25 is provided at the center along the entire (longitudinal) length of the upper-side pedestal 21 and thereby partitions the interior of the upper-side pedestal 21 into upper and lower portions (halves). As shown in FIG. 3, first and second elongated holes 26 are formed in the center plate 25 near the front and rear ends thereof and each extends in the front-rear direction. Furthermore, the first and second elongated holes 26 are each aligned with the upper and lower slits 23, 24 in plan view. First and second lock nuts 27 are respectively provided in the elongated holes 26 such that the first and second lock nuts 27 are respectively capable of moving (sliding) along (within) the first and second elongated holes 26 in the front-rear direction while the first and second lock nuts 27 are blocked from rotating within the elongated holes 26. Mounting bolts (e.g., hex bolts) 28 are passed through corresponding holes 71 in the base 61 of the compound slide miter saw 60 and are screwed, from above, into the first and second lock nuts 27 in order to affix (secure) the compound slide miter saw 60 to the upper-side pedestal (sliding rail) 21. Because the lock nuts 27 are movable in the front-rear direction, the work stand brackets 20 are adapted/configured to secure a variety of different benchtop power tools having different-sized bases in the front-rear direction. Outward of the lock nuts 27 in the front and rear directions, respectively, rubber feet 29 are fixed to the lower surface of the upper-side pedestal 21 by bolts 30 that pass through the lower slit 24 from above. Thus, as will be discussed below, four feet 29 are disposed on the two upper-side pedestals 21 such that the four feet 29 can support the saw 60 when the saw 60 is removed from the main body 4 while the brackets 20 are still attached to the saw 60 and the entire unit is placed on a flat surface.

Turning now to the lower-side pedestal 22, a connecting plate 31 and a locking plate 32, whose lengths in the front-rear direction differ and each of which have a U shape with side edges that are bent in the longitudinal direction, are fixedly connected in the left-right direction, as can be seen in FIG. 4. The connecting plate 31, which is the shorter one, is oriented such that its bent side edges extend downward. The connecting plate 31 is connected to the upper-side pedestal 21 by bolts 33 (see FIG. 6), which pass through the lower slit 24, and nuts 34, 34 fastened on the bolts 33 in the state in which the connecting plate 31 contacts the center of the lower surface of the upper-side pedestal 21 in the longitudinal direction.

The locking plate 32, which is the longer one, is disposed adjoining the connecting plate 31 at a location at which its front end is aligned with a front end of the connecting plate 31 and its rear end protrudes rearward beyond the connecting plate 31. The locking plate 32 is connected to one of the bent sides (one of the vertically extending sides) of the connecting plate 31 by front and rear screws 36A, 36B, which pass through left and right side plates 35, 35 of the locking plate 32, and front and rear nuts 37, 37 that are respectively screwed onto the front and rear screws 36A, 36B. A first engaging part 38A is adapted/configured to be engageable with the first engagement part (flange) 8A on the front side of the stand main body 4. The first engaging part 38A is fixed, by the screw 36A on the front side, between the side plates 35 at the front end of the locking plate 32 with an attitude such that a catch part (claw, hook) 39 at the tip faces rearward. Front-end lower parts of the side plates 35 are formed such that they match, in side view, the shapes of the first engaging part 38A and the catch part 39. The first engaging part 38A preferably has a complimentary (rigid) shape, e.g., a hook shape, to the first engagement part 8A so that the first engagement part 8A interlocks (form fits) within the first engaging 38A. In other words, the first engagement part 38A does not require any movable parts. It is sufficient that the first engaging part 38A is shaped to engage with the first engagement part 8A in the mounted state of the work stand bracket 20.

On the other hand, a second engaging part 38B is provided on the rear-end side of the locking plate 32 and comprises a first lever 41 and a second lever 42 that are each movable (pivotable) relative to the locking plate 32.

Figure 7:
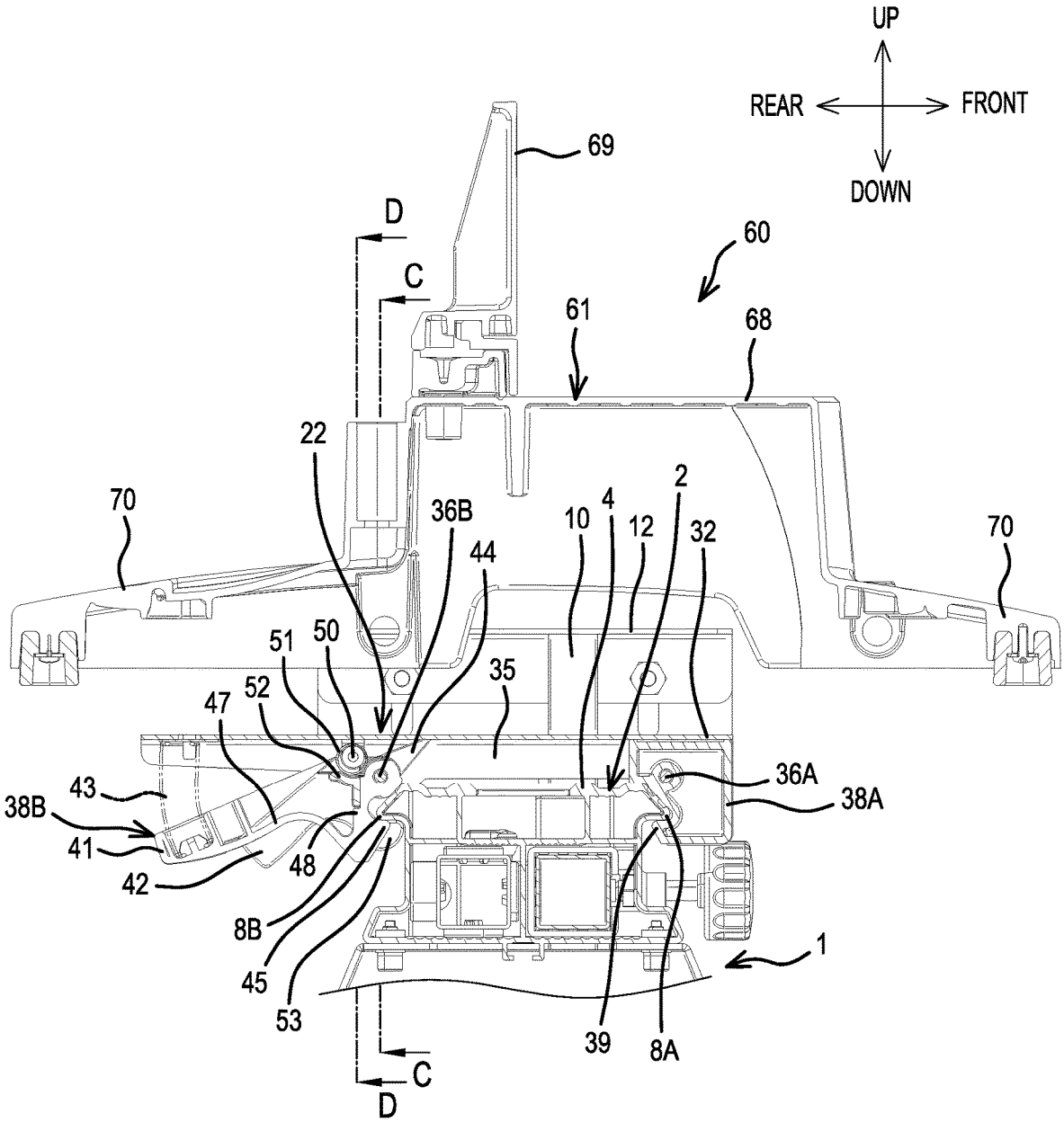
FIG. 7 is a cross-sectional view taken along line B-B in FIG. 2.

As can best be seen in FIG. 6, the first lever 41 has an L shape in side view. An intermediate portion (fulcrum part) of the first lever 41 is pivotably coupled to the side plates 35 of the locking plate 32 by the screw 36B at a location at which it is slightly rearward of the center of the locking plate 32 in the front-rear direction. A rear-end portion of the first lever 41 is biased downward away from the locking plate 32 by a coil spring 43, which is provided between the first lever 41 and the rear end of the locking plate 32. As shown in FIG. 7, a projection 44 projects generally forwardly from the intermediate portion (fulcrum part) of the first lever 41 (where the screw 36B passes through the first lever 36). When the first lever 41 is pivoted by the coil spring 43 in the counterclockwise direction in FIG. 7 such that the projection 44 makes contact with the lower surface of the locking plate 32, the projection 44 restricts (blocks) further pivoting of the first lever 41 in the counterclockwise direction.

In addition, as shown also in FIG. 8A, at a front-end portion of the first lever 41, a first catch part (claw) 45 is formed that is adapted/configured to engage, from below, with the second engagement part 8B on the rear side of the stand main body 4 at the location where the first lever 41 (and thus the first catch part 45) is pivotably restricted by the projection 44. Furthermore, at the center of the first lever 41 in the left-right direction, a slit 46 is formed and extends in the front-rear direction, thereby dividing a front-end portion of the first lever 41 into left and right halves (the rear-end portion of the first lever 41 does not have the slit 46, as can be seen in FIG. 6). As shown also in FIG. 8B, two recesses 47 are respectively formed on (in) the left and right inner surfaces of the first lever 41, which form the slit 46. The front ends of the recesses 47 are located rearward of the screw 36B. In addition, first stoppers 48 are formed on the front ends of the respective recesses 47. Each of the first stoppers 48 has a step shape that faces upward at the pivotably restricted position (FIG. 7) of the first lever 41.

Referring again to FIGS. 4-7, the second lever 42 is a plate body that is housed inside the slit 46 of the first lever 41 and has an L shape in side view. An intermediate portion (fulcrum part) of the second lever 42 is pivotably coupled, by a pin 50 oriented in the left-right direction, to the locking plate 32 at a location that is rearward and upward of the screw 36B. A rear-end portion of the second lever 42 is biased downward away from the locking plate 32 (i.e. the same biasing direction as the first lever 41), by a torsion spring 51, which is wound around the pin 50. One end of the torsion spring 51 is secured to the locking plate 32 and the other end of the torsion spring 51 is secured to the rear-end portion of the second lever 42.

Figure 8B:
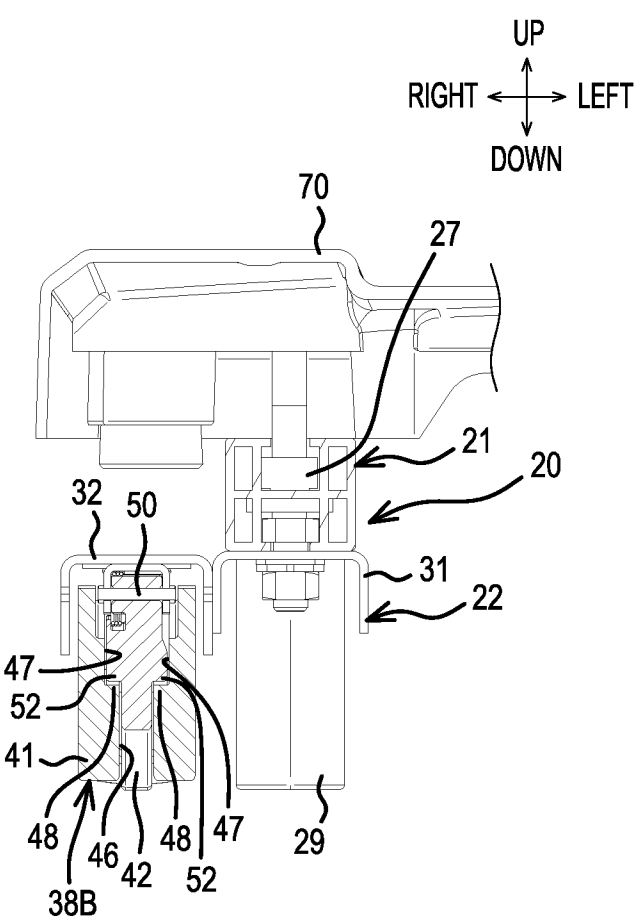
FIG. 8B is an enlarged, cross-sectional view taken along line D-D in FIG. 7.

In addition, as can be seen in FIG. 8B, two second stoppers 52, which respectively protrude to the left and right, are provided on the left and right side surfaces of the second lever 42 downward of the pin 50. At the pivotably restricted position (FIG. 7) of the first lever 41, the second stoppers 52 make contact with front-end edges of the recesses 47, 47 on the inner surfaces of the first lever 41 and have an attitude such that they extend downward facing from the pin 50, as can also be seen in FIG. 7. In this state, the rear-end portion of the second lever 42 is caused to protrude downward from the slit 46 against the biasing force of the torsion spring 51. At this pivotably restricted position, the second stoppers 52 are arranged (oriented) rectilinearly in the up-down direction on the upper side of the first stoppers 48, and the lower surfaces of the second stoppers 52 are caused to approach the first stoppers 48.

Figure 8A:
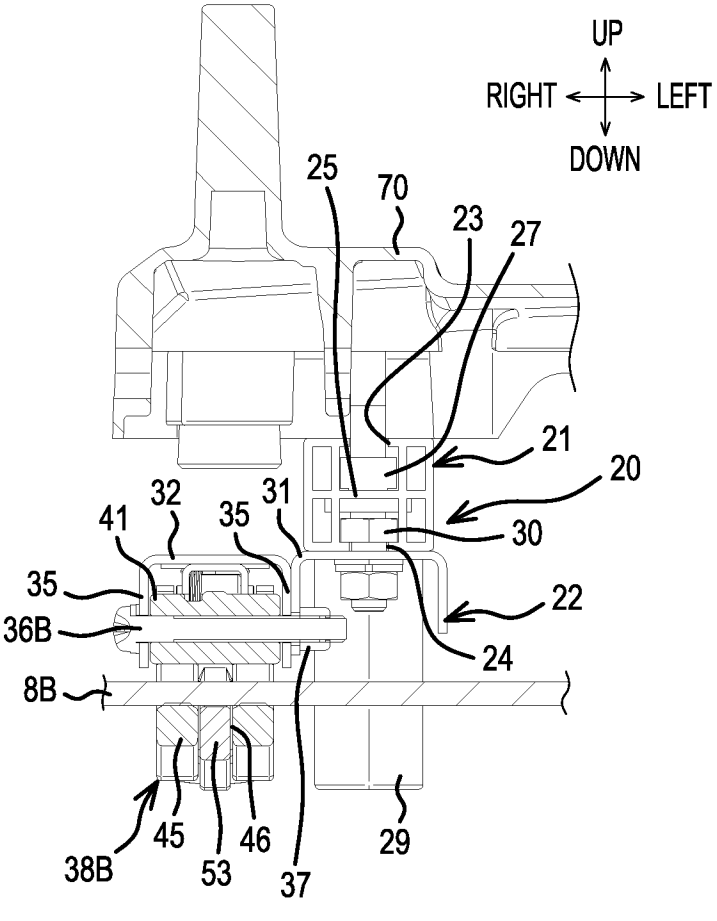
FIG. 8A is an enlarged, cross-sectional view taken along line C-C in FIG. 7.

Furthermore, as shown also in FIGS. 4, 6 and 8A, a second catch part (claw) 53 is formed on the front-end portion of the second lever 42. The second catch part 53 also is adapted/configured to engage, from below, with the second engagement part 8B on the rear side of the stand main body 4 at the pivotably restricted position of the first lever 41, as can be seen in FIG. 7.

Figure 9A:
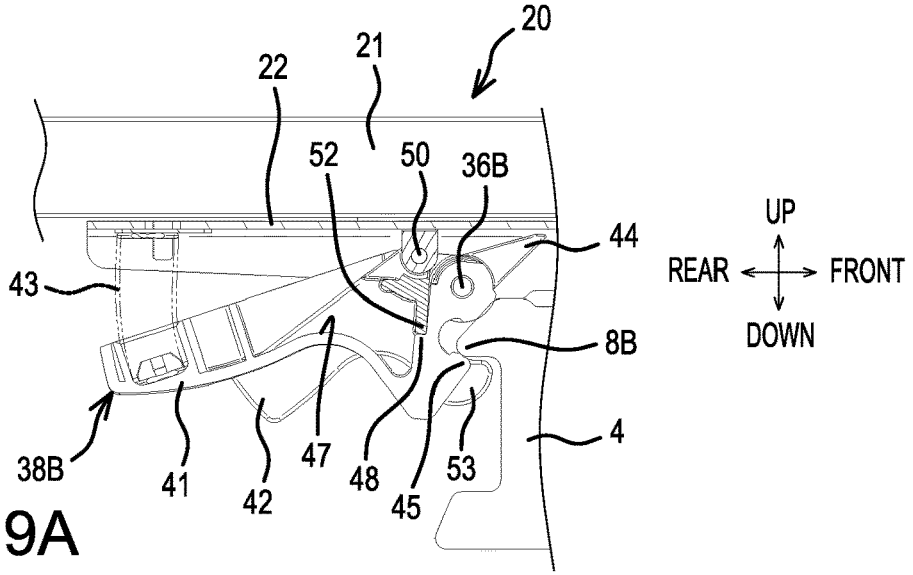

Operation of the second engaging part 38B, more particularly the first and second levers 41, 42, will now be explained. Starting from the pivotably restricted position of the first lever 41 (i.e. the position shown in FIG. 7), if the rear-end portion of the first lever 41 alone (only) is manually squeezed to pivot it upward, then the second lever 42 also attempts to pivot at the same time, because the second stoppers 52 of the second lever 42 are in contact with the front ends of the recesses 47. However, as shown in FIG. 9A, because the first stoppers 48 and the second stoppers 52 contact one another, pivoting of both levers 41, 42 is restricted (blocked), i.e. only the first lever 41 can pivot and the second lever 42 does not significantly move/pivot. In this state, the first catch part 45 and the second catch part 53 have been slightly pivoted downward from the second engagement part 8B. However, because the second catch part 53 does not separate rearward from the second engagement part 8B (i.e. the second catch part 53 remains underneath the second engagement part (flange) 8B), detachment (removal) of the bracket 20 from the second engagement part 8B is obstructed (blocked, prevented). Therefore, the saw 60 remains locked to (undetachable from) the stand main body 4. But, because the downward pivoting of the first and second catch parts 45, 53 reduces or releases the locking (clamping) force applied by the bracket 20 to the second engagement part 8B, the bracket 20 can now be freely (without restriction) slid along the longitudinal direction of the stand main body 4 to any arbitrary slide (longitudinal) position. After the desired slide (longitudinal) position has been determined, if the squeezing of the rear-end portion of the first lever 41 is released, then the first lever 41 once again returns to the pivotably restricted position (owing to the biasing force of the coil spring 43), whereby the first catch part 45 is caused to engage with (clamp onto) the second engagement part 8B. Consequently the bracket 20 can be secured at the desired slide (longitudinal) position such that further sliding of the bracket 20 relative to the stand main body 4 is restricted (blocked, hindered) by the clamping (locking) force applied by the first catch part 45 onto the second engaging part 8B.

Figure 9B:
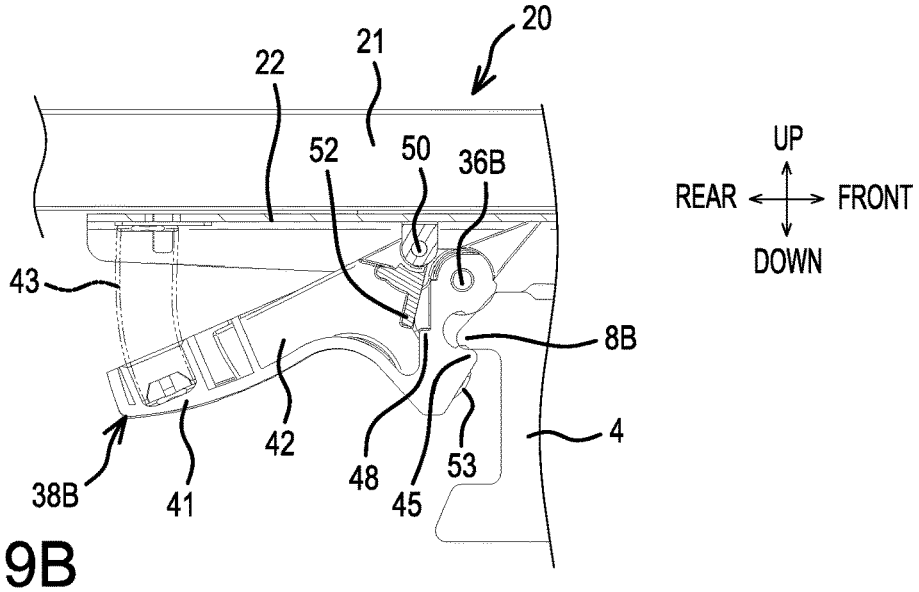
Figure 9C:
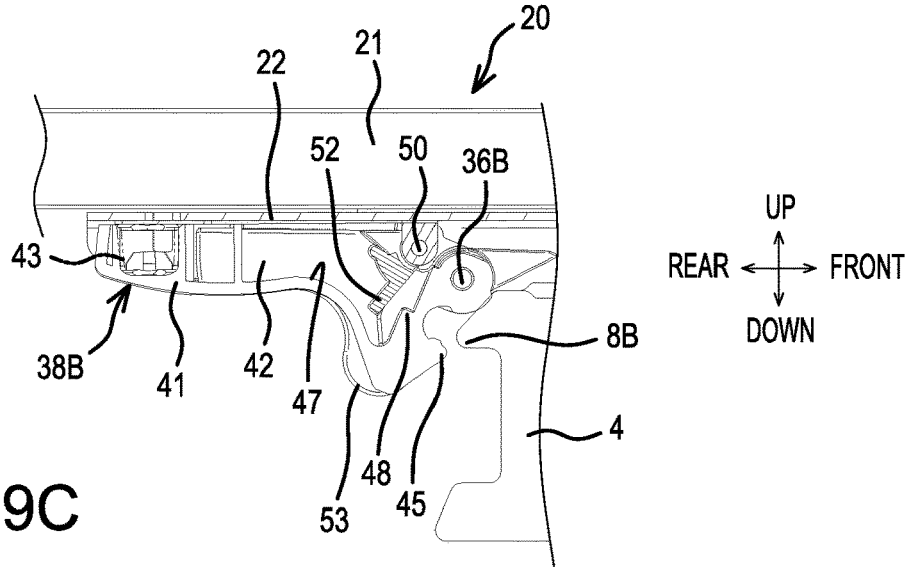
Figure 10A:
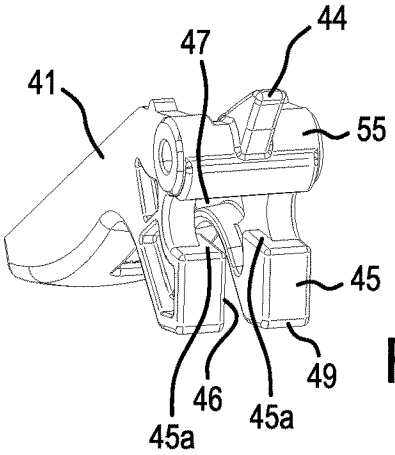
Figure 10B:
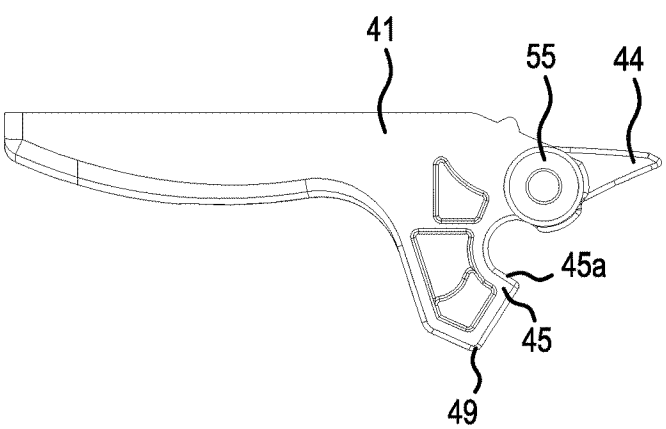
Figure 10C:
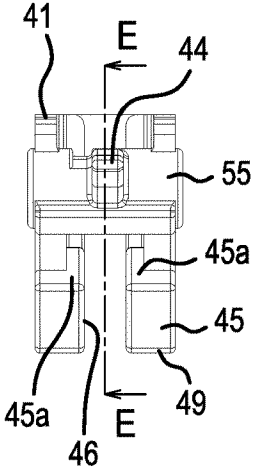
Figure 10D:
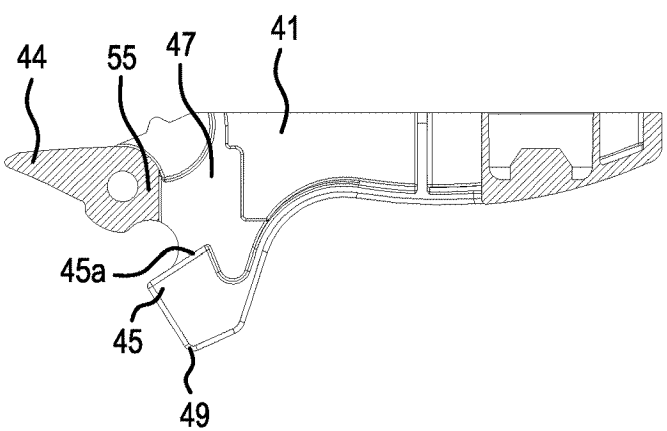

On the other hand, when both the rear-end portion of the first lever 41 and the rear-end portion of the second lever 42 are squeezed to simultaneously pivot them both upward, as shown in FIG. 9B, the first lever 41 can continue to be pivoted to the position shown in FIG. 9C because the second lever 42, which normally protrudes from the slit 46, is pivoted first, thereby causing the second stoppers 52 to separate from the position at which they are proximate to the first stoppers 48. Furthermore, owing to the offset (distance) between the screw 36B, which is the pivot center of the first lever 41, and the pin 50, which is the pivot center of the second lever 42, the first stoppers 48 and the second stoppers 52 remain offset (spaced apart) from one another in the pivoting direction, and therefore interference between them no longer occurs. Consequently, as shown in FIG. 9C, the first lever 41 and the second lever 42, which have unlocked from one another, can be pivoted until the first catch part 45 and the second catch part 53 both separate (become spaced apart) from the second engagement part 8B in the rearward direction (i.e. neither the first catch part 45 nor the second catch part 53 remains underneath the second engagement part (flange) 8B). Therefore, if the rear end of the bracket 20 is lifted upward in this state, then the first and second levers 41, 42 will separate from the stand main body 4 as the rear end of the bracket 20 tilts upward relative to the support frame 2. Then, if the rear end of the bracket 20 is moved forward in this tilted state, the catch part 39 of the engaging part 38A on the front side will separate from the first engagement part 8A, whereby the bracket 20 can be removed entirely from the stand main body 4. Of course, these operations (movements) must be performed on both of the brackets 20 at the same time so that both of the brackets 20 (and thus the saw 60 if it is still affixed to the brackets 20) can be removed (separated) from the support frame 2.

Thus, even though their pivot centers differ in the forward-rearward direction, the pivoting directions of the first lever 41 and the second lever 42 are the same when the bracket 20 is being mounted or demounted (removed), and therefore this design makes it easy to manipulate the first and second levers 41, 42 to perform both mounting and demounting (removal) operations.

To mount the bracket 20 on the stand main body 4, the catch part 39 of the first engaging part 38A on the front side is first engaged with the first engagement part 8A and then the rear end of the bracket 20 is lowered, as is, until it becomes horizontal. In so doing, the first and second levers 41, 42 are caused to move rearward of the stand main body 4, because the contact of the first and second catch parts 45, 53 with the tilted surface of the second engagement part 8B causes the first and second levers 41, 42 to pivot rearward automatically until the first and second catch parts 45, 53 surmount (overcome) the second engagement part 8B. Subsequently, owing to the biasing forces of the coil spring 43 and the torsion spring 51, the first and second levers 41, 42 pivot forward until the first and second catch parts 45, 53 once again are engaged with (clamped onto) the second engagement part 8B, thereby securing the bracket 20 to the stand main body 4 (in the vertical direction of the stand main body 4) and inhibiting sliding movement of the bracket 20 in the longitudinal direction of the stand main body 4.

It is noted that the compound slide miter saw 60, which is fixed to the work stand 1, comprises a turntable 62 that is horizontally rotatable and is disposed at the center of the base 61, which has on its upper surface a surface on which a workpiece is placed, as shown in FIG. 1-3. In addition, the compound slide miter saw 60 holds (slidably supports) a slide bar 64, which is capable of being slid in the front-rear direction, on an upper end of an arm 63, which is provided upright rearward of the turntable 62. On the front end of the slide bar 64, a main body 65, which comprises a circular saw blade that is rotatably driven by a motor and is oriented longitudinally, is provided such that it is movable up and down (vertically) and is biased toward an upper-limit position. A handle 66 for manually moving the saw blade in the up-down direction is provided on the upper end of the main body 65. A guide fence 69, against which the workpiece is placed to position the workpiece, spans a right mount part 67 and a left mount part 68 of the base 61 located on the left and right of the turntable 62. Leg parts 70, which are oriented in the front-rear direction, are respectively formed on lower parts of the mount parts 67, 68. The above-mentioned mounting holes 71, which are for fixing to the base 61 to the work stand 1 (by passing bolts 28 therethrough), are formed in both ends of the leg parts 70 at the front and the rear.

When fixing the compound slide miter saw 60 onto the work stand 1 configured as described above, the left and right brackets 20 on the stand main body 4 are positionally adjusted such that, in the state in which the first levers 41 of the two brackets 20 alone (only) have been squeezed, the left and right upper-side pedestals 21 are respectively located below the leg parts 70 of the base 61. Furthermore, the compound slide miter saw 60 is mounted such that it spans the left and right upper-side pedestals 21, and the lock nuts 27 are respectively positioned directly below the mounting holes 71 of the leg parts 70.

After positioning the lock nuts 27, the mounting bolts 28 are respectively passed through the leg parts 70, the mounting holes 71 and the upper slits 23 of the upper-side pedestals 21 and then screwed into the lock nuts 27, thereby coupling the leg parts 70 to the upper-side pedestals 21. If mounting bolts 28 having a long dimension are provided, then, even if the thickness of the leg parts 70 changes (i.e. different saws have different sized leg parts 70), a variety of types of power tools (e.g., benchtop saws) can be secured to the work stand 1 with just one type (size) of bolt.

When the saw 60 has been secured to the work stand 1, a user can cut a workpiece by setting the workpiece on the base 61 and the turntable 62 and then lowering the main body 65 by grasping and pushing the handle 66 to cause the rotating saw blade to saw through the workpiece. If the workpiece is long, then the workpiece can be maintained in a stable horizontal state and cut without difficulty by placing the workpiece so that it bridges (spans, extends across) the base 61 and one or both of the support roller 11 and/or the support plate 12 held on the auxiliary bars 5.

Furthermore, if an angle cut is desired, a grip 72, which protrudes forward from the turntable 62, is manually moved to rotate the turntable 62. In this regard, it is noted that, even if the rotational angle thereof becomes large, there is no risk that the grip 72 will interfere with the mounting bolts 28 because the mounting bolts 28 do not protrude above the leg parts 70.

Furthermore, if it is desired to change the position of the compound slide miter saw 60 relative to the work stand 1 in the left-right (longitudinal) direction, then the first levers 41 of the left and right brackets 20 alone (only) may be squeezed to reduce the locking (clamping) force that the brackets 20 apply to the stand main body 4, whereby the brackets 20 can then be slid in the longitudinal direction of the stand main body 4 to the desired longitudinal location. After the positioning is completed, the squeezing of the first levers 41, 41 is released so that the first catch parts 45 once again engage with (clamp onto) the second engagement part 8B and the brackets 20 are thereby fixed (secured) at the desired slide (longitudinal) position.

In addition, if it becomes desired to use the compound slide miter saw 60 by placing it directly on the ground or another flat surface, it is not necessary to detach the saw 60 from the brackets 20 by removing the bolts 28. Rather, if both first and second levers 41, 42 on the left and right brackets 20 are squeezed, then the engagement with the second engagement part 8B on the rear side is released. Consequently, if the rear ends of the left and right brackets 20, 20 are lifted (tilted) up in this state together with the compound slide miter saw 60 and pushed toward the front side, then the engagement with the first engagement part 8A on the front side is also released, whereby the compound slide miter saw 60 can be removed from the work stand 1 with the brackets 20 still attached to the saw 60. In this state, the brackets 20, 20 can be placed directly on the ground. More specifically, because the feet 29 of the upper-side pedestals 21 protrude downward below the first and second engaging parts 38A, 38B, the feet 29 at the four corners alone make contact with the ground or other flat surface and can support the base 61 in a horizontal orientation with the first and second engaging parts 38A, 38B above the ground or other flat surface.

Thus, in one aspect of the present teachings, the bracket 20 and the work stand 1 according to the above-described first embodiment preferably may comprise: the upper-side pedestal 21 and the lower-side pedestal 22 (pedestals), which are mounted on the support frame 2 and to which the compound slide miter saw 60 is fixable; and first and second engaging parts 38A, 38B, which are provided on the lower-side pedestal 22 at locations at which they sandwich the support frame 2 from both sides in the horizontal direction orthogonal to the support frame 2 and are engageable with the first and second engagement parts 8A, 8B, respectively, provided on both sides of the support frame 2. The second engaging part 38B preferably comprises the first lever 41 and the second lever 42 (first manipulation part and second manipulation part, respectively), which are each adapted/configured to engage with and disengage from the second engagement part 8B. By manipulating (operating) the first lever 41 to disengage (separate) it from the second engagement part 8B, it becomes possible for the lower-side pedestal 22 to move (slide) along the support frame 2. By manipulating (operating) both the first lever 41 and the second lever 42 at the same time to disengage them both from the second engagement part 8B, it becomes possible for the lower-side pedestal 22 to be removed (detached) from the support frame 2. Preferably, the directions for manipulating (moving, pivoting) the first lever 41 and the second lever 42 to lock (engage, claim) and unlock (release, detach) them are the same. Consequently, in such an embodiment, position (slide) adjustment, mounting/demounting, etc. with respect to the support frame 2 can be performed smoothly, thereby increasing work efficiency.

In the first embodiment, the first manipulation part and the second manipulation part respectively correspond to the first lever 41 and the second lever 42, and the end portions thereof are pivotably coupled to the lower-side pedestal 22. Because the first and second manipulation parts have the same pivoting-manipulation directions, which are the locking/unlocking-manipulation directions, it is possible to smoothly and easily disengage both the first and second manipulation parts from the second engagement part 8B by simply pivoting (squeezing) both the first and second manipulation parts in the same direction at the same time.

In addition, if the pivot centers of the first lever 41 and the second lever 42 are disposed such that they are offset (spaced apart) from one another in the front-rear direction, and if the first stoppers 48 and the second stoppers 52, which make contact with one another to restrict (block) pivoting of both of them when the unlocking (releasing, detachment) manipulation is performed only on the first lever 41 (i.e. only the first lever 41 is squeezed), are provided on the first lever 41 and the second lever 42, the pivoting restriction (blockage) when the first lever 41 alone is manipulated and the release of the restriction when both the levers 41, 42 are manipulated simultaneously can be reliably performed with a small part count.

Furthermore, because the second lever 42 is housed (accommodated) inside the slit 46, which is oriented in the front-rear direction and is provided in the first lever 41, space is saved even though two levers are provided. Furthermore, the simultaneous squeezing of the first and second levers 41, 42 can be performed in a simple manner, thereby making the bracket 20 easy to operate.

In another aspect of the present teachings, the bracket 20 and the work stand 1 according to the above-described first embodiment preferably comprise: the upper-side pedestal 21 and the lower-side pedestal 22 (pedestals), which are mounted on the support frame 2 and to which the compound slide miter saw 60 is fixable; and first and second engaging parts 38A, 38B, which are provided on the lower-side pedestal 22 at locations at which they sandwich the support frame 2 from both sides in the horizontal direction orthogonal to the support frame 2 and are engageable with the engagement parts 8A, 8B, respectively, provided on both sides of the support frame 2. The second engaging part 38B comprises the first lever 41 (manipulation part), which is capable of engaging with and disengaging from the second engagement part 8B, and the second lever 42 (restricting part), which restricts the range of movement of the first lever 41 when only the first lever 41 is manually moved (pivoted). However, by causing both the first lever 41 and the second lever 42 to move in the same direction at the same time, it becomes possible for the lower-side pedestal 22 to be removed (detached) from the support frame 2. Thereby, position adjustment, mounting/demounting, etc. with respect to the support frame 2 can be performed smoothly, and it is possible to increase work efficiency.

It is noted that, although the second lever is housed in the slit of the first lever in the above-described first embodiment, a recess may be provided on a side surface of the first lever, and the second lever may be provided in that recess. In the alternative, the first lever and the second lever can also be disposed such that they are adjoining (adjacent) in the left-right direction, without providing the recess. In these alternate embodiments, the stoppers that contact one another are provided only on the side surfaces that are mutually contiguous. The length of each lever, the shape of each catch part, and the like also can be suitably modified, and the levers may be formed by combining a plurality of components.

In addition, although the front-side engaging part is configured as a hook shape and the rear-side engaging part is configured as two levers in the above-mentioned first embodiment, the rear and front configurations may be reversed, both the front and rear sides may be configured as two levers, etc.

Furthermore, in the above-described first embodiment, although the bracket pedestal is divided into the upper-side pedestal, to which the power tool is fixable, and the lower-side pedestal, which contacts and is securable to the support frame, it is also possible to provide the power tool on the upper surface, and the engaging parts (manipulation part and restricting part) on the lower surface, of a single pedestal. The structures for securing the power tool to the brackets are also not limited to the above-described first embodiment.

Furthermore, the structure of the work stand, too, can be suitably modified, such as by omitting one or both of the auxiliary bars, by making the legs extendable instead of foldable, by configuring the legs as a linked structure, or the like. The power tool to be fixed to the work stand may be any type of power tool configured to be used by placing a base of the power tool on a flat surface and is not limited to a compound slide miter saw. For example, work stand and the bracket for the work stand may be configured to support and secure, e.g., a wide variety of benchtop (tabletop) power tools such as a miter saw, a chop saw, other types of cutters and saws, planers, sanders, etc. All such modifications are also applicable to the following additional embodiments of the present teachings.

Second Embodiment

Next, other embodiments of a bracket for a work stand according to the present teachings are explained with reference to FIGS. 10-13. In the following, structural members that are the same as those in the above-described first embodiment are assigned the same reference numbers and symbols, and redundant explanations thereof are omitted; instead, the explanation will focus on those structural members that differ from the first embodiment.

Figure 12A:
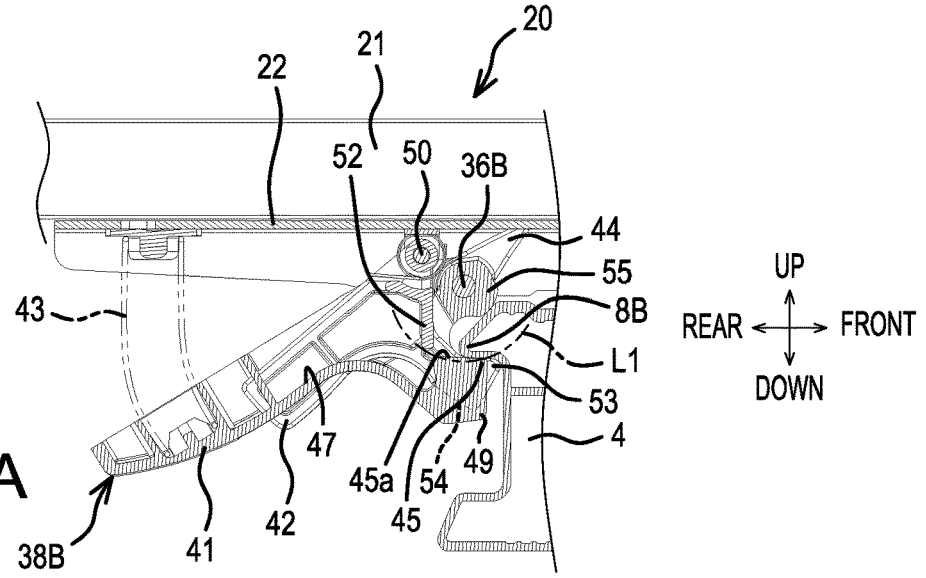
FIG. 12A shows the state in which the first and second levers of FIGS. 10 and 11 are engaged with (clamped onto) engagement parts.

It is first noted that the first stoppers (48) according to the above-described first embodiment are not provided on the first lever 41 shown in FIG. 10. Instead, on the first lever 41 of FIG. 10, flat parts 45*a* are formed on the left and right on the upper surfaces of the first catch parts 45, which respectively project toward the recesses 47. The flat parts 45*a* sandwich the slit 46 and extend in the front-rear direction (i.e. horizontally) at the pivotably restricted position (see FIG. 12A) of the first lever 41. As shown in FIG. 12A, the flat parts 45*a* are located downward and forward of the second stoppers 52 of the second lever 42 when the second lever 42 is in engagement with (clamping) the second engagement part 8B. An arcuate trajectory L1 is indicated by a chain line and shows the trajectory when the front and rear ends of the flat parts 45*a* pivot about the screw 36B. The arcuate trajectory L1 passes by the lower sides and rearward of the lower end of the second stoppers 52. First corner parts 49 are formed downward of the first catch parts 45 and protrude forward and downward when the first lever 41 is in engagement with (clamping) the second engagement part (flange) 8B of the stand main body (rail) 4.

Figure 11A:
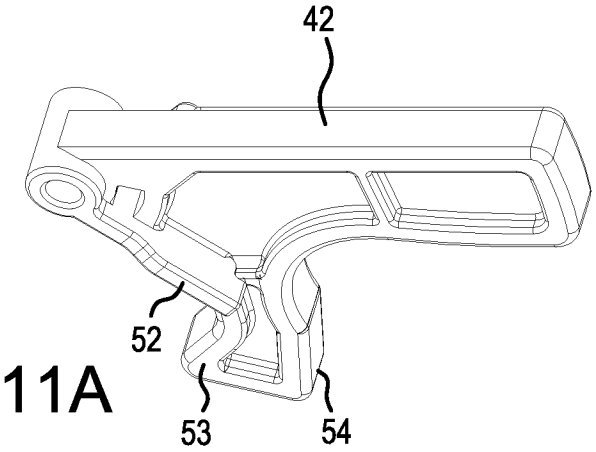
Figure 11C:
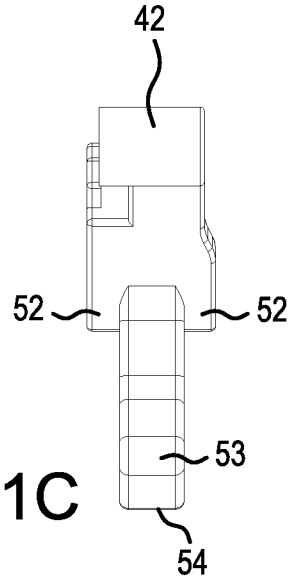
Figure 11B:
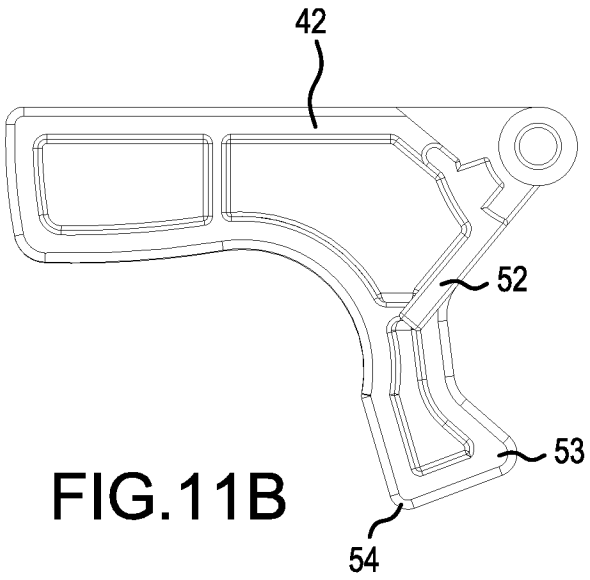

As shown in FIGS. 11A-11C, a second corner part 54 is formed on the second lever 42 and protrudes downward when the second lever 42 is in engagement with (clamping) the second engagement part 8B.

Figure 12B:
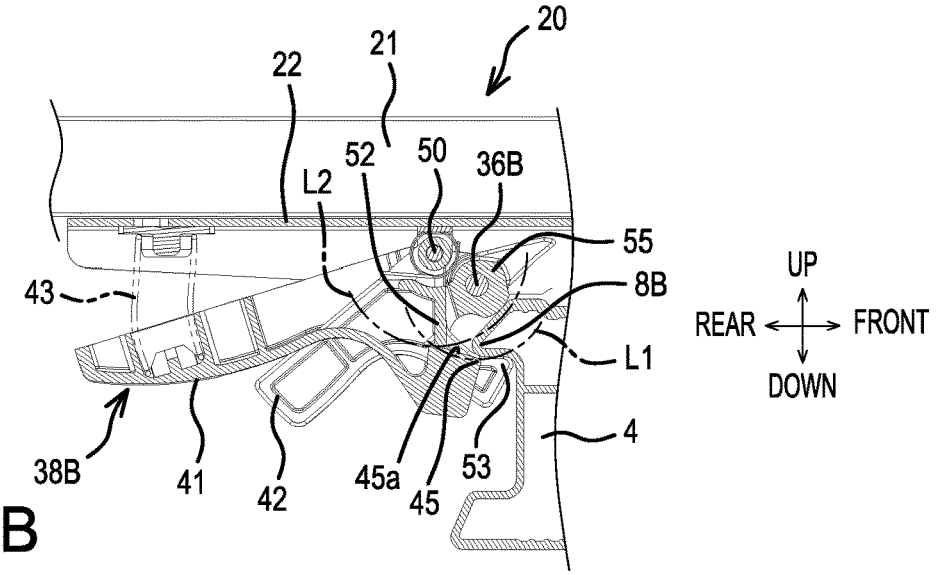
FIG. 12B shows the state in which the first lever alone (only) has been pivoted.

Operation of the second embodiment will now be explained. Starting from the engaged state shown in FIG. 12A, if the first lever 41 alone (only) is pivoted upward, the flat parts 45*a* move rearward along the arcuate trajectory L1 and eventually make contact with the lower ends of the second stoppers 52 as shown in FIG. 12B. At the time of this contact, the flat parts 45*a* assume a tilted attitude that is lower in the front, and the rear ends of the flat parts 45*a* are located rearward and slightly upward of the lower ends of the second stoppers 52. Consequently, if an attempt is made to pivot the second lever 42 upward after the first lever 41 alone has been pivoted (squeezed) to this position, rearward movement of the second stoppers 52 is hindered (blocked, obstructed) by the flat parts 45*a*. That is, the second lever 42 can not be pivoted in case the first lever 41 alone has been pivoted upward to the position shown in FIG. 12B.

In this state, if an attempt is made to pivot the first lever 41 alone, the second stoppers 52 of the second lever 42 are caused to be pivotably biased frontward (toward the side of engagement (clamping contact) with the second engagement part 8B) along a pivot trajectory L2, which is indicated by a chain line and centered on the pin 50, by the guidance (pushing) of the tilting flat parts 45*a*. Owing to this wedge action (wedge effect), movement of the second lever 42 in an attempt to pivot together with the first lever 41 is hindered (obstructed) by friction between the second lever 42 and the first lever 41. That is, the second catch part 53 remains in a state of engagement (clamping) with the second engagement part 8B. Furthermore, because the second stoppers 52 of the second lever 42 make contact with the flat parts 45*a* when the second lever 42 in the locked (clamped) state, further pivoting manipulation of the first lever 41 also becomes impossible.

Figure 12C:
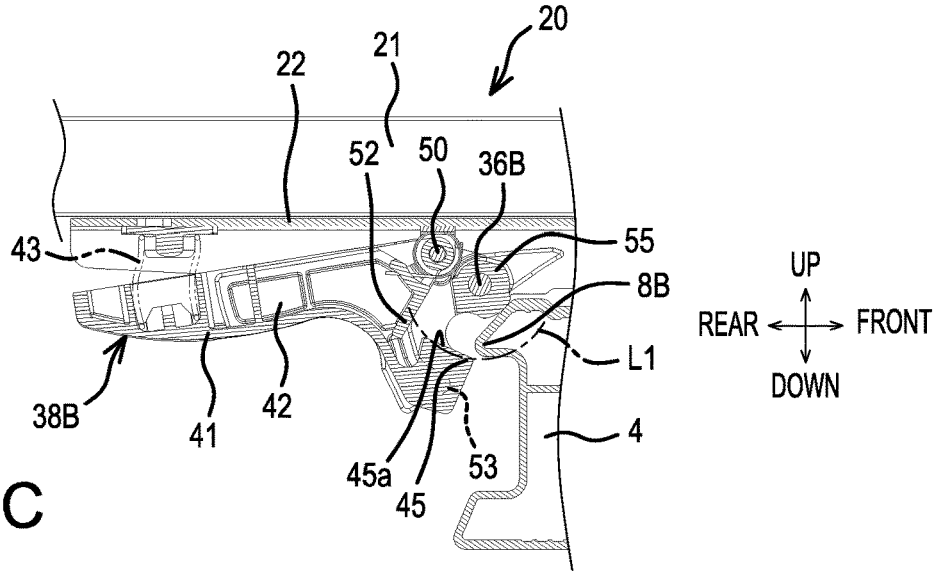
FIG. 12C shows an initial state of pivoting of both of the first and second levers.

On the other hand, if the rear-end portion of the first lever 41 and the rear-end portion of the second lever 42 are both squeezed and caused to pivot upward at the same time, as shown in FIG. 12C, the second lever 42, which protrudes from the slit 46, pivots first, which causes the second stoppers 52 to move to the outer side of the pivot trajectory L1 of the flat parts 45*a*. Therefore, because the flat parts 45*a* do not make contact with the second stoppers 52, the first lever 41 also can continue to be pivoted. Consequently, the first lever 41 and the second lever 42 can be pivoted until the first catch parts 45 and the second catch part 53 both separate from the second engagement part 8B as shown in FIG. 12C.

Then, when the rear end of the bracket 20 is lifted (tilted) upward, the first and second levers 41, 42 separate (detach) from the stand main body 4. Consequently, if the rear end of the bracket 20 is moved forward in this state, then the catch part 39 of the first engaging part 38A on the front side separates from the first engagement part 8A, and thereby the bracket 20 can be removed from the stand main body 4.

Figure 13:
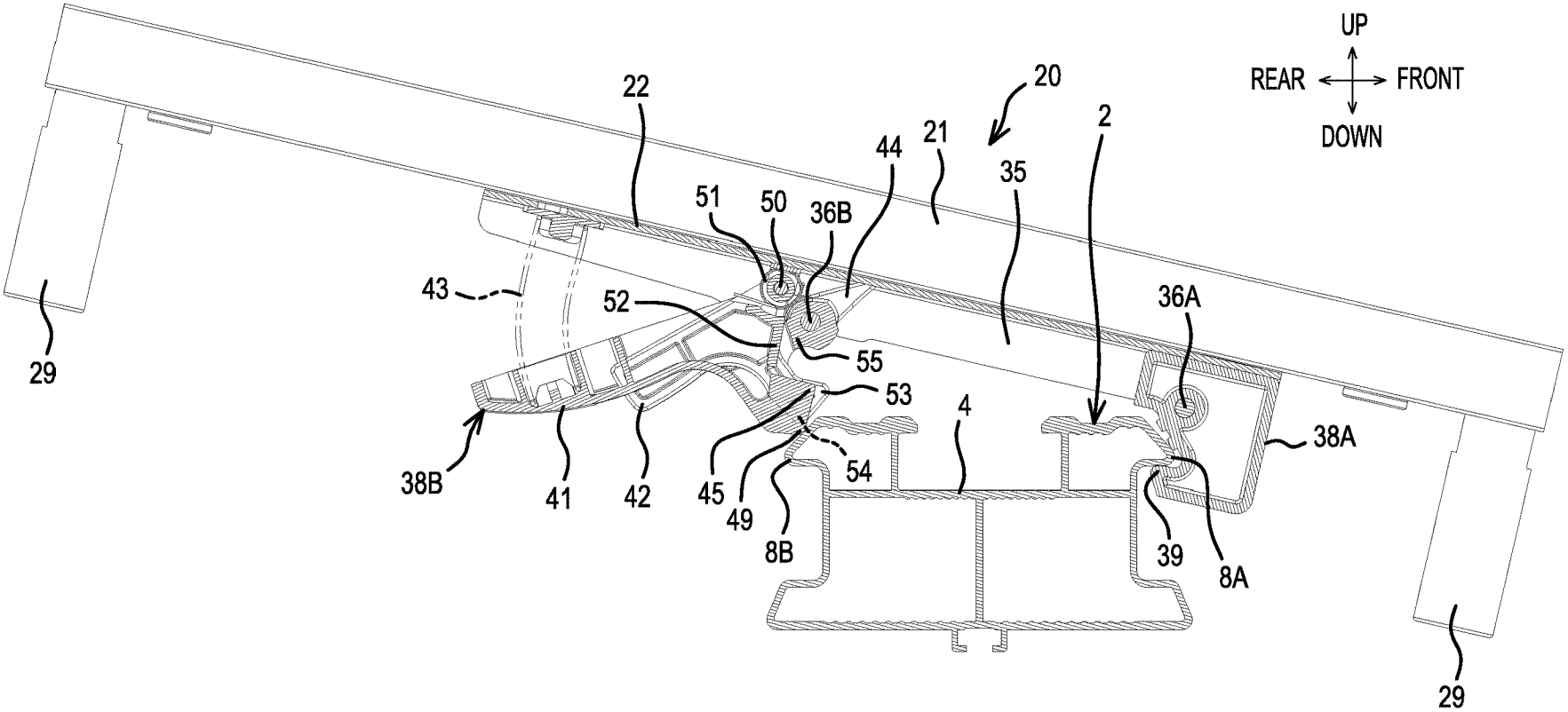
FIG. 13 shows the state of the first and second levers while they are in the process of being re-engaged with one of the engagement parts.

It is noted that, while the bracket 20 is being removed, as shown in FIG. 13, the second lever 42 is pivotably biased downward by the torsion spring 51. In addition, a front surface of the second lever 42, on which the second stoppers 52 are provided, makes contact with a fulcrum part 55 of the first lever 41. As described above, the screw 36B passes through the fulcrum part 55 of the first lever 41. Therefore, the second lever 42 is pivotably restricted (blocked) at this contact position.

When the bracket 20 is to be mounted, the catch part 39 of the first engaging part 38A on the front side is first engaged with the first engagement part 8A. Then, in this state, the rear end of the bracket 20 is lowered until the bracket 20 is horizontal. In so doing, the first corner parts 49 of the first catch parts 45 come into contact with the tilted surface of the engagement part 8B, which causes the first lever 41 to automatically pivot upward against the biasing force of the coil spring 43. As the bracket 20 is further lowered, the second corner part 54 of the second lever 42 also makes contact with the tilted surface of the second engagement part 8B as shown in FIG. 13.

When the fulcrum part 55 makes contact with the second stoppers 52 as the first lever 41 pivots, the second lever 42 also pivots upward against the biasing force of the torsion spring 51. As a result, the first and second catch parts 45, 53 surmount the second engagement part 8B. Subsequently, as shown in FIG. 12A, the first and second levers 41, 42 pivot in the locking (engagement, clamping) direction owing to the biasing forces of the coil spring 43 and the torsion spring 51. Therefore, the first and second catch parts 45, 53 once again are caused to engage with (clamp) the second engagement part 8B, thereby fixing (securing) the bracket 20 to the stand main body 4.

Thus, the bracket 20 and the work stand 1 according to the above-described second embodiment also make it possible to remove the lower-side pedestal 22 from the support frame 2 by performing an unlocking (release) manipulation (operation), in which the first manipulation part (the first lever 41) and the second manipulation part (the second lever 42) both disengage (detach) from the second engagement part 8B at the same time, and the locking/unlocking-manipulation directions of the first lever 41 and the second lever 42 are the same. Furthermore, if the unlocking (release) manipulation (operation) is performed only on the first lever 41, then it becomes impossible for the second lever 42 to be unlocked (unclamped) from the stand main body 4.

Owing to this configuration, the work for mounting on and demounting from the support frame 2 can be performed smoothly, thereby improving work efficiency. Furthermore, reliable locking (clamping) by the second lever 42 also becomes possible.

In particular, the flat parts 45*a* (contact portion(s)), which make contact with the second lever 42 when the first lever 41 alone undergoes the unlocking (release) manipulation (operation), are respectively provided on the first catch parts 45 of the first lever 41. Therefore, owing to this contact with the flat parts 45*a*, it becomes impossible to unlock (detach, unclamp) the second lever 42 in case the first lever 41 alone has been manually operated to perform an unlocking (release) operation. Thereby, locking of the second lever 42, when the first lever 41 has been used (operated), can be performed simply.

In addition, as the first lever 41 pivots, the flat parts 45*a* pivotably bias the second lever 42 in the locking (engagement, clamping) direction toward the second engagement part 8B. Thereby, locking (engagement, clamping) can be performed more reliably.

In addition, the contact portions are the flat parts 45*a*, which, as the first lever 41 pivots, assume a tilted attitude and pivotably bias the second lever 42 in the locking (engagement, clamping) direction. Thereby, the contact portions can be formed in a simple manner.

As was noted above, modifications of the above-described second embodiment also are possible, in the same manner as in the above-described first embodiment. For example, a modification is possible in which a recess is provided on a side surface of the first lever, and the second lever is housed inside that recess. In the alternative, a modification is possible in which the first lever and the second lever are disposed contiguously (adjacently) in the left-right direction, without providing the recess. In these modifications, the flat parts and the second stoppers can be provided on just the side surfaces that are mutually contiguous (adjacent).

The contact portions are not limited to being flat parts and may be curved-surface parts (concave surfaces or convex surfaces).

As used herein, the terms "manipulation" or "manipulate" are intended to mean "manually operate" and/or "manually operable", as well as "manually move" and/or "manually movable".

Additional aspects of the present teachings include, but are not limited to:

1. A work stand bracket (20) for fixing a power tool (60) on a support frame (2) of a work stand (1) having legs (3), which support the support frame (2), the work stand bracket (20) comprising:

a pedestal (21, 22) adapted to be mounted on the support frame (2) and fixed to the power tool (60); and first and second engaging parts (38A, 38B) provided on the pedestal (22) at locations at which the first and second engaging parts (38A, 38B) are capable of sandwiching opposite sides of the support frame (2) in a horizontal direction that is orthogonal to the support frame (2) and respectively engaging with first and second engagement parts (8A, 8B) that are respectively provided on the opposite sides of the support frame (2);

wherein:

at least one of the first and second engaging parts (38B) comprises a first manipulation part (41) and a second manipulation part (42), which are adapted to be manipulated to engage with and disengage from the second engagement part (8B);

the pedestal (22) is disengageable from the second engagement part (8B) and removable from the support frame (2) by simultaneously manipulating both the first manipulation part (41) and the second manipulation part (42);

both of the first manipulation part (41) and the second manipulation part (42) move in the same first direction to engage with the second engagement part (8B) and in the same second direction to disengage from the second engagement part (8B); and if only the first manipulation part (41) is moved in the second direction, then the second manipulation part (42) is blocked from moving in the second direction.

2. The work stand bracket (20) according to the above Aspect 1, wherein:

the first manipulation part is a first lever (41), the second manipulation part is a second lever (42), end portions of the first and second levers (41, 42) are each pivotably coupled to the pedestal (22), and both of the first lever (41) and the second lever (42) are pivotable relative to the pedestal in the same first direction to engage with the second engagement part (8B) and in the same second direction to disengage from the second engagement part (8B).

3. The work stand bracket (20) according to the above Aspect 2, wherein:

the pivot center (36B) of the first lever (41) and the pivot center (50) of the second lever (42) are disposed such that they are offset from one another in the horizontal direction; and a contact portion (45*a*) is provided on the first lever (41) and is arranged to make contact with the second lever (42) when the first lever (41) alone is pivoted in the second direction, thereby blocking the second lever (42) from pivoting in the second direction.

4. The work stand bracket (20) according to the above Aspect 3, wherein in the state that the first lever (41) has been pivoted in the second direction, the contact portion (45*a*) is adapted to pivotably bias the second lever (42) in the first direction toward the second engagement part (8B).

5. The work stand bracket (20) according to the above Aspect 4, wherein the contact portion (45*a*) is a flat part that, in the state that the first lever (41) has been pivoted in the second direction, is arranged to assume a tilted attitude and pivotably bias the second lever (42) in the first direction.

6. A work stand bracket (20) for fixing a power tool (60) provided on a support frame (2) of a work stand (1) having legs (3), which support the support frame (2), the work stand bracket (20) comprising:

a pedestal (21, 22) adapted to be mounted on the support frame (2) and fixed to the power tool (60); and first and second engaging parts (38A, 38B) provided on the pedestal (22) at locations at which the first and second engaging parts (38A, 38B) are capable of sandwiching opposite sides of the support frame (2) in a horizontal direction that is orthogonal to the support frame (2) and respectively engaging with first and second engagement parts (8A, 8B) that are respectively provided on the opposite sides of the support frame (2);

wherein:

at least one of the first and second engaging parts (38B) comprises a first manipulation part (41) and a second manipulation part (42), which are adapted to be manipulated to engage with and disengage from the second engagement part (8B);

the pedestal (22) is movable along the support frame (2) by manipulating the first manipulation part (41) to disengage the first manipulation part (41) from the second engagement part (8B);

the pedestal (22) is disengageable from the second engagement part (8B) and removable from the support frame (2) by simultaneously manipulating both of the first manipulation part (41) and the second manipulation part (42); and both of the first manipulation part (41) and the second manipulation part (42) move in the same first direction to engage with the second engagement part (8B) and in the same second direction to disengage from the second engagement part (8B).

7. The work stand bracket (20) according to the above Aspect 6, wherein:

the first manipulation part is a first lever (41), the second manipulation part is a second lever (42), end portions of the first and second levers (41, 42) are each pivotably coupled to the pedestal (22), and both of the first lever (41) and the second lever (42) are pivotable relative to the pedestal in the same first direction to engage with the second engagement part (8B) and in the same second direction to disengage from the second engagement part (8B).

8. The work stand bracket (20) according to the above Aspect 7, wherein:

the pivot center (36B) of the first lever (41) and the pivot center (50) of the second lever (42) are disposed such that they are offset from one another in the horizontal direction; and stoppers (48, 52) are respectively provided on the first lever (41) and the second lever (42) and are arranged to make contact with one another to block pivoting of both the first lever (41) and the second lever (42) in case only one of the first lever (41) and the second lever (42) has been pivoted in the second direction.

9. The work stand bracket (20) according to the above Aspect 7 or 8, wherein the second lever (42) is housed within a slit (46), which is provided in the first lever (46) and is oriented in the horizontal direction.

10. A work stand bracket (20) for fixing a power tool (60) on a support frame (2) of a work stand (1) having legs (3), which support the support frame (2), the work stand bracket (20) comprising:

a pedestal (21, 22) adapted to be mounted on the support frame (2) and fixed to the power tool (60); and first and second engaging parts (38A, 38B) provided on the pedestal (22) at locations at which the first and second engaging parts (38A, 38B) are capable of sandwiching opposite sides of the support frame (2) in a horizontal direction that is orthogonal to the support frame and respectively engaging with first and second engagement parts (8A, 8B) that are respectively provided on the opposite sides of the support frame (2);

wherein:

at least one of the first and second engaging parts (38) comprises a manipulation part (41) adapted to be manipulated to engage with and disengage from the second engagement part (8B), and a restricting part (42) adapted to restrict the range of movement of the manipulation part (41); and the pedestal (22) is removable from the support frame (2) by simultaneously moving the manipulation part (41) and the restricting part (42) in the same direction.

11. The work stand bracket (20) according to the above Aspect 10, wherein the manipulation part (41) and the restricting part (42) are adapted such that movement of the manipulation part alone in a direction away from the second engagement part (8B) brings the manipulation part (41) into contact with the restricting part (42), thereby restricting further movement of the manipulation part (41) in the direction away from the second engagement part (8B).

12. The work stand bracket (20) according to the above Aspect 11, wherein:

the manipulation part is a first lever (41) having an end portion that is pivotably coupled to the pedestal (22); and the restricting part is a second lever (42) having an end portion that is pivotably coupled to the pedestal (22).

13. The work stand bracket (20) according to the above Aspect 12, wherein the pivot center (36B) of the first lever (41) and the pivot center (50) of the second lever (42) are disposed such that they are offset from one another in the horizontal direction.

14. A work stand (1), comprising:

a support frame (2);

legs (3), which support the support frame (2); and the work stand bracket (20) according to any one of the above Aspects 1-13 provided on the support frame (2) such that the work stand bracket (20) is mountable on and demountable from the support frame (2);

wherein the power tool (60) is fixable to the work stand bracket (20).

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved work stands and brackets for use with such work stands.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Finally, a work stand according to the present teachings should be used only with power tools, e.g., saws, planars, etc., specifically designed and authorized by the manufacturer for use with the work stand. Usage of a work stand that is not specifically designed for the power tool may be hazardous and could possibly lead to serious personal injury and/or equipment damage. Furthermore, usage of a power tool that is not securely mounted on the work statement also may be hazardous and could possibly lead to serious personal injury and/or equipment damage.

EXPLANATION OF THE REFERENCE NUMBERS

1 Work stand
2 Support frame
3 Leg
4 Stand main body
8A, 8B Engagement parts
20 Work stand bracket
21 Upper-side pedestal
22 Lower-side pedestal
27 Lock nut
28 Mounting bolt
31 Connecting plate
32 Locking plate
35 Side plate
36A, 36B Screws
38A, 38B Engaging parts
39 Catch part
41 First lever
42 Second lever
43 Coil spring
45 First catch part
45*a* Flat part
46 Slit
48 First stopper
50 Pin
52 Second stopper
53 Second catch part
55 Fulcrum part
60 Compound slide miter saw
61 Base
65 Main body
70 Leg part
71 Mounting hole

We claim:

1. A work stand bracket for securing a base of a power tool to a support frame of a work stand supported by legs, the support frame extending in a longitudinal direction and having first and second engagement parts extending in the longitudinal direction and defined on opposite sides of the support frame in a horizontal direction perpendicular to the longitudinal direction, the work stand bracket comprising:

a pedestal having a first side configured to be removably mounted on the support frame and a second side configured to be fixed to the base of the power tool; and first and second engaging parts provided on the pedestal in a spaced apart arrangement such that the first and second engaging parts are configured to sandwich the opposite sides of the support frame in the horizontal direction, the first and second engaging parts being configured to respectively engage the first and second engagement parts;

wherein:

the second engaging part comprises first and second manipulation parts configured to be manipulated to selectively engage with and disengage from the second engagement part;

the pedestal is disengageable from the second engagement part and removable from the support frame by simultaneously manipulating both the first manipulation part and the second manipulation part;

both of the first manipulation part and the second manipulation part move in a first direction to engage with the second engagement part and in a second direction to disengage from the second engagement part, the first direction being opposite of the second direction; and the first manipulation part and the second manipulation part are configured such that manipulation of only the first manipulation part to move the first manipulation part in the second direction causes movement of the second manipulation part to be blocked in the second direction.

2. The work stand bracket according to claim 1, wherein:

the first manipulation part comprises a first lever having a first end portion pivotably coupled to the pedestal at a first pivot center;

the second manipulation part comprises a second lever having a first end portion pivotably coupled to the pedestal at a second pivot center that is spaced apart from the first pivot center; and both of the first lever and the second lever are pivotable relative to the pedestal in the same first direction to engage with the second engagement part and in the same second direction to disengage from the second engagement part.

3. The work stand bracket according to claim 2, wherein:

the first pivot center is spaced apart from the second pivot center in the horizontal direction; and at least one contact portion is defined on the first lever and is arranged to make contact with the second lever when only the first lever alone is pivoted in the second direction to thereby block the second lever from pivoting in the second direction.

4. The work stand bracket according to claim 3, wherein in a state that the first lever has been pivoted in the second direction, the at least one contact portion is configured to pivotably bias the second lever in the first direction toward the second engagement part.

5. The work stand bracket according to claim 4, wherein:

the at least one contact portion includes a flat surface that is parallel to the longitudinal and horizontal directions in a resting state of the first lever;

the flat surface of the at least one contact portion is configured to move from being parallel to the longitudinal and horizontal directions in the resting state of the first lever to being oblique relative to the longitudinal and horizontal directions as the first lever is pivoted away from the resting state in the second direction; and when the first lever is in the oblique state, the flat surface pivotably biases the second lever in the first direction.

6. The work stand bracket according to claim 5, wherein the pedestal is configured to be movable along the longitudinal direction of the support frame by manipulating only the first manipulation part in the second direction to disengage the first manipulation part from the second engagement part while the second manipulation part continues to block detachment of the work stand bracket from the support frame in a vertical direction that is perpendicular to both the longitudinal direction and the horizontal direction.

7. The work stand bracket according to claim 6, further comprising:

a coil spring attached to the pedestal and pivotably biasing a second end portion of the first lever in the first direction toward the resting state of the first lever; and a torsion spring attached to the pedestal and pivotably biasing the second lever in the first direction;

wherein:

the first engaging part has a claw that is complementary to the first engagement part of the support frame such that the claw is capable of engaging the first engagement part of the support frame;

the first lever has a first catch part that is complementary to the second engagement part of the support frame such that the first catch part is capable of engaging the second engagement part of the support frame; and the second lever has a second catch part that is complementary to the second engagement part of the support frame such that the second catch part is capable of engaging the second engagement part of the support frame.

8. The work stand bracket according to claim 1, wherein the pedestal is configured to be movable along the longitudinal direction of the support frame by manipulating the first manipulation part in the second direction to disengage the first manipulation part from the second engagement part.

9. A work stand, comprising:

the work stand bracket according to claim 1;

the support frame; and the legs supporting the support frame in a vertical direction that is perpendicular to the longitudinal direction and the horizontal direction;

wherein:

the work stand bracket is detachably mounted on the support frame; and the base of the power tool is fixed to the work stand bracket.

10. A work stand bracket for securing a base of a power tool to a support frame of a work stand supported by legs, the support frame extending in a longitudinal direction and having first and second engagement parts extending in the longitudinal direction and defined on opposite sides of the support frame in a horizontal direction perpendicular to the longitudinal direction, the work stand bracket comprising:

a pedestal having a first side configured to be removably mounted on the support frame and a second side configured to be fixed to the base of the power tool; and first and second engaging parts provided on the pedestal in a spaced apart arrangement such that the first and second engaging parts are configured to sandwich the opposite sides of the support frame in the horizontal direction, the first and second engaging parts being configured to respectively engage the first and second engagement parts;

wherein:

the second engaging part comprises first and second manipulation parts configured to be manipulated to selectively engage with and disengage from the second engagement part;

the pedestal is disengageable from the second engagement part and removable from the support frame by simultaneously manipulating both the first manipulation part and the second manipulation part;

both of the first manipulation part and the second manipulation part pivot in a first rotational direction to engage with the second engagement part and in a second rotational direction to disengage from the second engagement part, the first rotational direction being opposite of the second rotational direction; and the pedestal is configured to be movable along the longitudinal direction of the support frame by manually pivoting only the first manipulation part in the second rotational direction to disengage the first manipulation part from the second engagement part while the second manipulation part continues to block removal of the pedestal from the support frame.

11. The work stand bracket according to claim 10, wherein:

the first manipulation part comprises a first lever having a first end portion pivotably coupled to the pedestal at a first pivot center;

the second manipulation part comprises a second lever having a first end portion pivotably coupled to the pedestal at a second pivot center that is spaced apart from the first pivot center; and both of the first lever and the second lever are pivotable relative to the pedestal in the same first rotational direction to engage with the second engagement part and in the same second rotational direction to disengage from the second engagement part.

12. The work stand bracket according to claim 11, wherein:

the first pivot center is spaced apart from the second pivot center in the horizontal direction;

at least one first stopper is defined on the first lever;

at least one second stopper is defined on the second lever; and the at least one first stopper is arranged to contact the at least one second stopper to block further pivoting of both the first lever and the second lever in response to only one of the first lever and the second lever being pivoted in the second direction.

13. The work stand bracket according to claim 12, wherein:

the second lever is disposed within a slit defined in the first lever; and the slit is oriented in the horizontal direction.

14. The work stand bracket according to claim 11, wherein the first lever and the second lever are configured such that manipulation of only the first lever to pivot the first lever in the second rotational direction causes pivoting of the second lever to be blocked in the second rotational direction.

15. A work stand, comprising:

the work stand bracket according to claim 10;

the support frame;

the legs supporting the support frame in a vertical direction that is perpendicular to the longitudinal direction and the horizontal direction; and wherein the work stand bracket is detachably mounted on the support frame; and the base of the power tool is fixed to the work stand bracket.

16. A work stand bracket for securing a base of a power tool to a support frame of a work stand supported by legs, the support frame extending in a longitudinal direction and having first and second engagement parts extending in the longitudinal direction and defined on opposite sides of the support frame in a horizontal direction, the work stand bracket comprising:

a pedestal having a first side configured to be removably mounted on the support frame and a second side configured to be fixed to the base of the power tool; and first and second engaging parts provided on the pedestal in a spaced apart arrangement such that the first and second engaging parts are configured to sandwich the opposite sides of the support frame in the horizontal direction, the first and second engaging parts being configured to respectively engage the first and second engagement parts;

wherein:

at least one of the first and second engaging parts comprises a manipulation part configured to be manipulated to engage with and disengage from the second engagement part, and a restricting part configured to restrict a range of movement of the manipulation part in response to movement of only the manipulation part without moving the restricting part; and the pedestal is configured to be removable from the support frame by simultaneously moving both the manipulation part and the restricting part in the same direction.

17. The work stand bracket according to claim 16, wherein the manipulation part and the restricting part are configured such that movement of only the manipulation part in a direction away from the second engagement part brings the manipulation part into contact with the restricting part, thereby restricting further movement of the manipulation part in the direction away from the second engagement part.

18. The work stand bracket according to claim 17, wherein:

the first manipulation part comprises a first lever having a first end portion pivotably coupled to the pedestal at a first pivot center; and the restricting part comprises a second lever having a first end portion pivotably coupled to the pedestal at a second pivot center that is spaced apart from the first pivot center.

19. The work stand bracket according to claim 18, wherein the first pivot center is spaced apart from the second pivot center in the horizontal direction.

20. A work stand, comprising:

the work stand bracket according to claim 16;

the support frame; and the legs supporting the support frame in a vertical direction that is perpendicular to the longitudinal direction and the horizontal direction;

wherein:

the work stand bracket is detachably mounted on the support frame; and the base of the power tool is fixed to the work stand bracket.

* * * * *